US007708363B2

(12) United States Patent
Hoshiyama et al.

(10) Patent No.: US 7,708,363 B2
(45) Date of Patent: May 4, 2010

(54) PRINTING APPARATUS AND PRINTING METHOD

(75) Inventors: Yoshiko Hoshiyama, Nagano-ken (JP); Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 905 days.

(21) Appl. No.: 11/452,298

(22) Filed: Jun. 14, 2006

(65) Prior Publication Data

US 2006/0279595 A1 Dec. 14, 2006

(30) Foreign Application Priority Data

Jun. 14, 2005 (JP) ..... 2005-173853

(51) Int. Cl.
*B41J 29/38* (2006.01)

(52) U.S. Cl. ..... 347/10; 347/9; 347/11

(58) Field of Classification Search ..... 347/10
See application file for complete search history.

(56) References Cited

U.S. PATENT DOCUMENTS

2003/0016257 A1* 1/2003 Asauchi et al. ..... 347/10
2006/0071961 A1* 4/2006 Tamura ..... 347/10

FOREIGN PATENT DOCUMENTS

JP 10-193587 A 7/1998

* cited by examiner

*Primary Examiner*—Matthew Luu
*Assistant Examiner*—Brian J Goldberg
(74) *Attorney, Agent, or Firm*—Sughrue Mion, PLLC

(57) ABSTRACT

A printing apparatus includes a head and a drive signal generating section. The head has an element performing operation for ejecting ink and ejects a plurality of types of inks, an amount of each ink ejected by the head being different depending on a designated tone value. The drive signal generating section generates a drive signal having a waveform section for operating the element and generates a plurality of types of the drive signals for a specific tone value, the waveform section of each of the drive signals for the specific tone value being different depending on the types of inks.

10 Claims, 17 Drawing Sheets

| color | ink | | process |
|---|---|---|---|
| cyan | dark cyan ink | light cyan ink | halftoning 1 |
| magenta | dark magenta ink | light magenta ink | halftoning 1 |
| yellow | yellow ink | | halftoning 2 |
| black | black ink | | halftoning 2 |

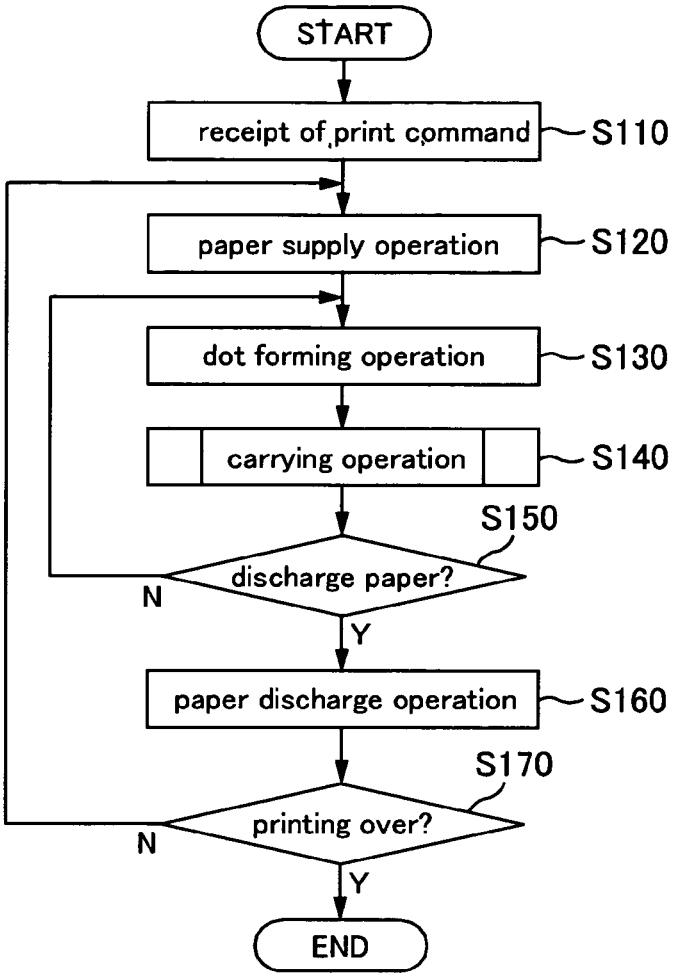

Fig. 12A

| ink \ tone level | applied drive pulse (specified by tone value) | | | |
|---|---|---|---|---|
| | no dot (00) | small dot (01) | medium dot (10) | large dot (11) |
| light cyan ink | micro -oscillation | small dot | second medium dot | first and third medium dot |
| dark cyan ink | micro -oscillation | small dot | second medium dot | first through third medium dot |
| light magenta ink | micro -oscillation | small dot | second medium dot | first and third medium dot |
| dark magenta ink | micro -oscillation | small dot | second medium dot | first through third medium dot |
| yellow ink | micro -oscillation | small dot | second medium dot | first through third medium dot |
| black ink | micro -oscillation | small dot | second medium dot | first through third medium dot |

Fig. 12B

| color | ink | formation of large dot |
|---|---|---|
| black | black ink | medium-dot pulse × 3 |
| cyan | cyan ink | medium-dot pulse × 3 |
| magenta | magenta ink | medium-dot pulse × 3 |
| yellow | yellow ink | medium-dot pulse × 2 |

| color | ink | formation of large dot |
|---|---|---|
| black 1 | pigment black ink | medium-dot pulse × 3 |
| black 2 | dye black ink | medium-dot pulse × 2 |
| cyan | dye cyan ink | medium-dot pulse × 2 |
| magenta | dye magenta ink | medium-dot pulse × 2 |
| yellow | dye yellow ink | medium-dot pulse × 2 |

light cyan ink , light magenta ink

| | applied drive pulse (specified by tone value) | | | | |
|---|---|---|---|---|---|
| | first drive pulse | second drive pulse | third drive pulse | fourth drive pulse | fifth drive pulse |
| no dot | × | × | × | × | × |
| small dot 1 | × | ○ | × | × | × |
| small dot 2 | × | × | ○ | × | × |
| medium dot 1 | × | ○ | × | ○ | × |
| medium dot 2 | × | ○ | ○ | × | × |
| large dot | × | ○ | ○ | ○ | × |

Fig. 17A cyan ink , magenta ink
yellow ink , black ink

| | applied drive pulse (specified by tone value) | | | | |
|---|---|---|---|---|---|
| | first drive pulse | second drive pulse | third drive pulse | fourth drive pulse | fifth drive pulse |
| no dot | × | × | × | × | × |
| small dot 1 | × | ○ | × | × | × |
| small dot 2 | × | × | ○ | × | × |
| medium dot 1 | × | ○ | × | ○ | × |
| medium dot 2 | ○ | × | ○ | × | × |
| large dot | ○ | × | ○ | × | ○ |

Fig. 17B

PRINTING APPARATUS AND PRINTING METHOD

CROSS-REFERENCE TO RELATED APPLICATIONS

The present application claims priority from Japanese Patent Application No. 2005-173853 filed on Jun. 14, 2005, which is herein incorporated by reference.

BACKGROUND

1. Technical Field

The present invention relates to a printing apparatus and a printing method.

2. Related Art

An inkjet printing apparatus is an apparatus which performs printing by ejecting ink from a head. The inkjet printing apparatus includes apparatuses such as a printer, a plotter, or a facsimile. Some of these printing apparatuses control operation of elements provided in a head by drive signals and eject ink; wherein an amount of ink is different depending on a tone level (see JP-A-10-193587, for example). The above-mentioned apparatuses perform such control using four tone levels: non-formation of a dot, a small dot, a medium dot, and a large dot. Thus, four-types of drive signals are generated and are applied to elements.

Some of the above-mentioned printing apparatuses eject a plurality of types of inks whose color and color material (dye or pigment) are different. In the printing apparatuses, the types of drive signals applied to elements are the same regardless of the type of ink.

In case of control as mentioned above, there is a problem that graininess deteriorates. It can be considered that the problem is caused because the perceived size of a dot is different depending on the type of ink with which the dot is formed even if an amount of ink used for formation of the dot is the same. For example, in case of a printing apparatus which performs printing by ejecting light ink and dark ink of a same color, a dot formed with light ink tends to be visually perceived larger than a dot formed with dark ink. This tendency becomes more conspicuous at a somewhat high tone level. Therefore, if an amount of ink used for dot-formation is the same between light ink and dark ink, the difference in size between a medium dot and a large dot which are formed with light ink becomes excessively great, for example, and this causes graininess to deteriorate.

SUMMARY

An advantage of some aspects of the present invention is to improve graininess.

A primary aspect of the invention for achieving the preceding advantage is a printing apparatus including:

a head which has an element performing operation for ejecting ink and which ejects a plurality of types of inks, an amount of each ink ejected by the head being different depending on a designated tone value; and a drive signal generating section which generates a drive signal having a waveform section for operating the element and which generates a plurality of types of the drive signals for a specific tone value, the waveform section of each of the drive signals for the specific tone value being different depending on the types of inks.

Other features of the present invention are described in the specification and the drawings.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 12A is a flowchart showing the processing during printing, and FIG. 12B is a table which shows, for each type of ink and for each of tone values, drive pulses applied to a piezo element;

FIG. 17A is a table showing control for light cyan ink or light magenta ink in other embodiments, and FIG. 17B is a table showing control for dark cyan ink or dark magenta ink, or yellow ink or black ink in other embodiments.

DESCRIPTION OF EXEMPLARY EMBODIMENTS

Figure 1:
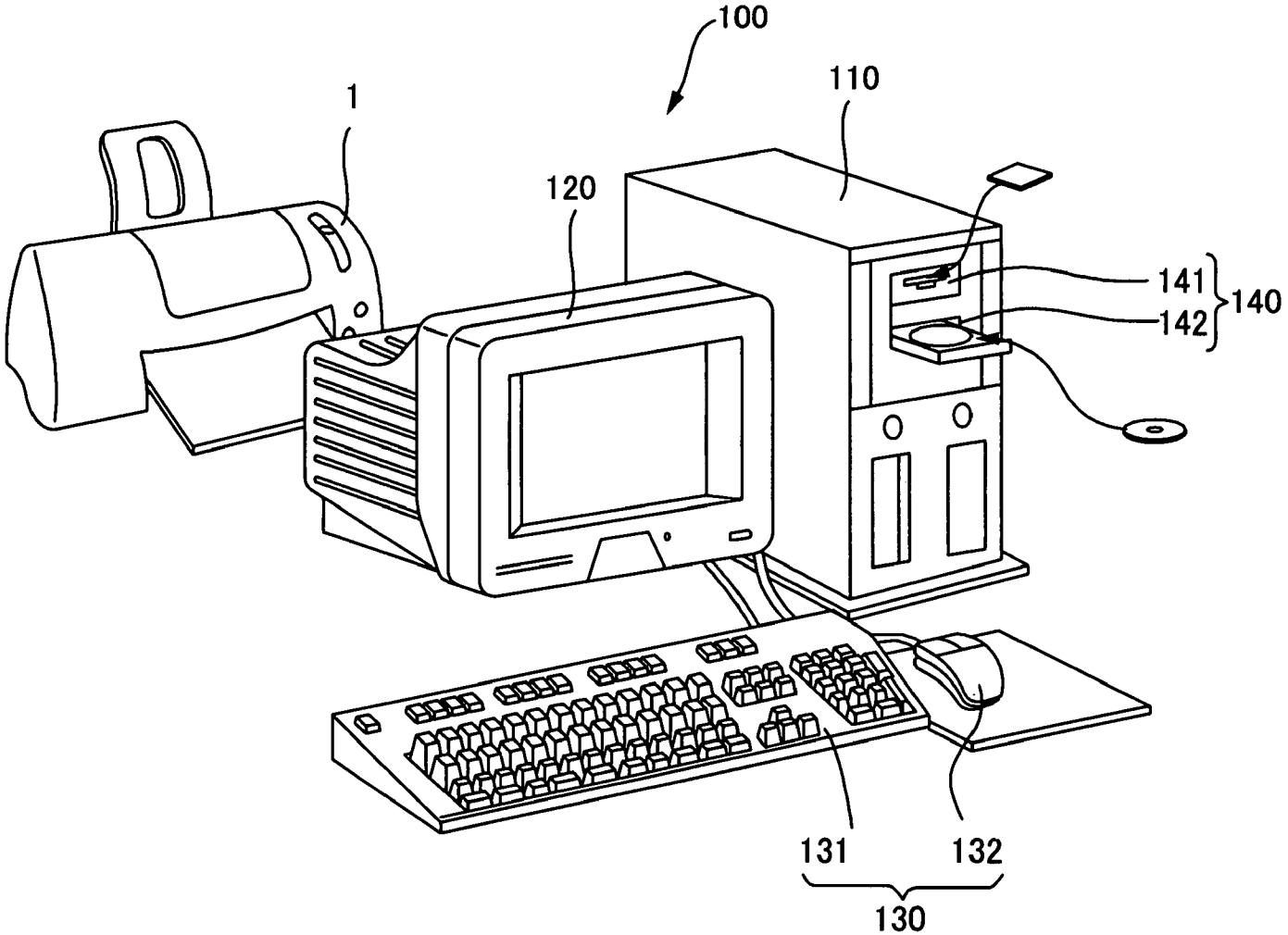
FIG. 1 is an explanatory diagram showing the configuration of a printing system.

The specification and the drawings describe at least the followings:

More specifically, an aspect of this invention achieves a printing apparatus including: a head which has an element performing operation for ejecting ink and which ejects a plurality of types of inks, an amount of each ink ejected by the head being different depending on a designated tone value; and a drive signal generating section which generates a drive signal having a waveform section for operating the element and which generates a plurality of types of the drive signals for a specific tone value, the waveform section of each of the drive signals for the specific tone value being different depending on the types of inks.

In this printing apparatus, when a specific tone value is designated, a drive signal generating section generates a drive signal having a waveform section appropriate to the type of ink. This enables to form a dot having a specific tone value in desired size, and graininess can be improved thereby.

In this printing apparatus, it is preferable that the drive signal generating section has an original drive signal generating section which generates an original drive signal having a plurality of the waveform sections, a switch which is arranged between the original drive signal generating section and the element and which is for generating from the original drive signal a drive signal to be applied to the element, and a switch controller which controls operation of the switch based on the designated tone value and the type of ink.

This printing apparatus enables to easily generate a plurality of the types of drive signals from a common original drive signal by controlling the switch.

In this printing apparatus, it is preferable that the drive signal generating section has a switch-operation information storing section storing, for each of the types of inks and each of the tone values, switch-operation information which is for determining the operation of the switch, and that the switch controller selects a piece of switch-operation information corresponding to the designated tone value and the type of ink and controls the operation of the switch using the selected switch-operation information.

This printing apparatus enables to perform printing operation at higher speed because a switch-operation information storing section stores switch-operation information for each of the types of inks and each of the tone values. This also facilitates support for using different types of ink.

In this printing apparatus, it is preferable that, in the drive signal generating section, a tone value corresponding to a dot which is larger than a predetermined size serves as the specific tone value.

This printing apparatus enables to effectively suppress deterioration of graininess which tends to be more conspicuous as a dot becomes larger.

In this printing apparatus, it is preferable that, in the drive signal generating section, a tone value corresponding to a largest dot serves as the specific tone value.

This printing apparatus enables to effectively suppress deterioration of graininess which is especially conspicuous in formation of a largest dot.

In this printing apparatus, it is preferable that the head ejects, as a plurality of the types of inks, light ink and dark ink of a same color and that the drive signal generating section generates for the specific tone value a plurality of types of the drive signals whose respective waveform sections differ such that an ejected amount of the light ink is less than an ejected amount of the dark ink.

This printing apparatus enables to improve graininess in an image printed with light ink and dark ink.

In this printing apparatus, it is preferable that the head ejects, as a plurality of the types of inks, inks each having different brightness when a concentration of a color material contained in each ink is the same among the inks and that the drive signal generating section generates for the specific tone value a plurality of types of the drive signals whose respective waveform sections differ such that an ejected amount of ink with high brightness is less than an ejected amount of ink with low brightness.

This printing apparatus enables to improve graininess in an image printed with ink having high brightness and ink having low brightness.

In this printing apparatus, it is preferable that the head ejects, as a plurality of the types of inks, black ink, cyan ink, magenta ink, and yellow ink each having different brightness when a concentration of a color material contained in each ink is the same among the inks, and that the drive signal generating section generates for the specific tone value a plurality of types of the drive signals whose respective waveform sections differ such that an ejected amount of the yellow ink with high brightness is less than an ejected amount of an other ink with low brightness.

This printing apparatus enables to improve graininess in an image printed with black ink, cyan ink, magenta ink, and yellow ink.

In this printing apparatus, it is preferable that the head ejects, as a plurality of the types of inks, dye ink and pigment ink, and that the drive signal generating section generates for the specific tone value a plurality of types of the drive signals whose respective waveform sections differ such that an ejected amount of the dye ink is less than an ejected amount of the pigment ink.

This printing apparatus enables to improve graininess in an image printed with pigment ink and dye ink.

In this printing apparatus, it is preferable that an ink storage container which stores a plurality of the types of inks and includes a container-side storage section which stores ink-type information indicating the types of inks stored, and that the drive signal generating section recognizes a type of ink to be ejected based on the ink-type information stored in the container-side storage section.

This printing apparatus facilitates operation of the apparatus because the type of ink is recognized depending on the ink storage container being used.

Also, a printing apparatus having the configuration described below is achievable. More specifically, an aspect of this invention achieves a printing apparatus including:

an ink storage container which stores a plurality of types of inks and which includes a container-side storage section which stores ink-type information indicating the types of inks stored; a head which has an element performing operation for ejecting ink and which ejects a plurality of the types of inks, an amount of each ink ejected by the head being different depending on a designated tone value; and a drive signal generating section which generates a drive signal having a waveform section for operating the element, and which has: an original drive signal generating section which generates an original drive signal having a plurality of the waveform sections, a switch which is arranged between the original drive signal generating section and the element and which is for generating from the original drive signal a drive signal to be applied to the element, a switch-operation information storing section storing, for each of the types of inks and each of the tone values, switch-operation information which is for determining operation of the switch, and a switch controller which selects a piece of switch-operation information corresponding to the designated tone value and the type of ink and which controls the operation of the switch using the selected switch-operation information; wherein the drive signal generating section recognizes a type of ink to be ejected based on the ink-type information stored in the container-side storage section, treats a tone value corresponding to a dot which is larger than a predetermined size or a tone value corresponding to a largest dot as a specific tone value, and generates a plurality of types of the drive signals for the specific tone value, the waveform section of each of the drive signals for the specific tone value being different depending on the types of inks; wherein: the head ejects, as a plurality of the types of inks: light ink and dark ink of a same color; black ink, cyan ink, magenta ink, and yellow ink each having different brightness when a concentration of a color material contained in each ink is the same among the types of inks; or dye ink and pigment ink; and the drive signal generating section generates for the specific tone value: a plurality of types of the drive signals whose respective waveform sections differ such that an ejected amount of the light ink is less than an ejected amount of the dark ink; a plurality of types of the drive signals whose respective waveform sections differ such that an ejected amount of the yellow ink with high brightness is less than an ejected amount of an other ink with low brightness; or a plurality of types of the drive signals whose respective waveform sections differ such that an ejected amount of the dye ink is less than an ejected amount of the pigment ink.

The advantage of some aspects of the present invention is achieved most effectively because this printing apparatus enables all effects mentioned above to be achieved.

Furthermore, an aspect of this invention achieves a printing method including: generating, for a specific tone value among a plurality of tone values, a plurality of types of drive signals each having a waveform section which is for operating an element performing operation for ejecting ink and which differs among types of inks; and ejecting ink at the specific tone value from a head by applying to the element a plurality of the types of drive signals.

Configuration of Printing System 100

Regarding Overall Configuration

First, a printing apparatus is described with a printing system 100. Here, FIG. 1 is an explanatory diagram showing the configuration of a printing system 100. The illustrated printing system 100 has a printer 1 as the printing apparatus and a computer 110 as a printing control apparatus. Specifically, the printing system 100 has the printer 1, the computer 110, a display device 120, an input device 130, and a record/play device 140. The printer 1 prints an image on a medium, such as paper, cloth, film and the like. This section below describes an example of a paper S, which is a typical medium (see FIG. 3A). The computer 110 is communicably connected to the printer 1. In order to make the printer 1 print an image, the computer 110 outputs print data corresponding to that image to the printer 1. This computer 110 has computer programs, such as an application program and a printer driver, installed thereon. The display device 120 has a display. This display device 120 is for displaying a user interface of the computer program, for example. The input device 130 is, for example, a keyboard 131 and a mouse 132. The record/play device 140 is, for example, a flexible disk drive device 141 and a CD-ROM drive device 142.

Computer 110

Regarding Configuration of Computer 110

Figure 2:
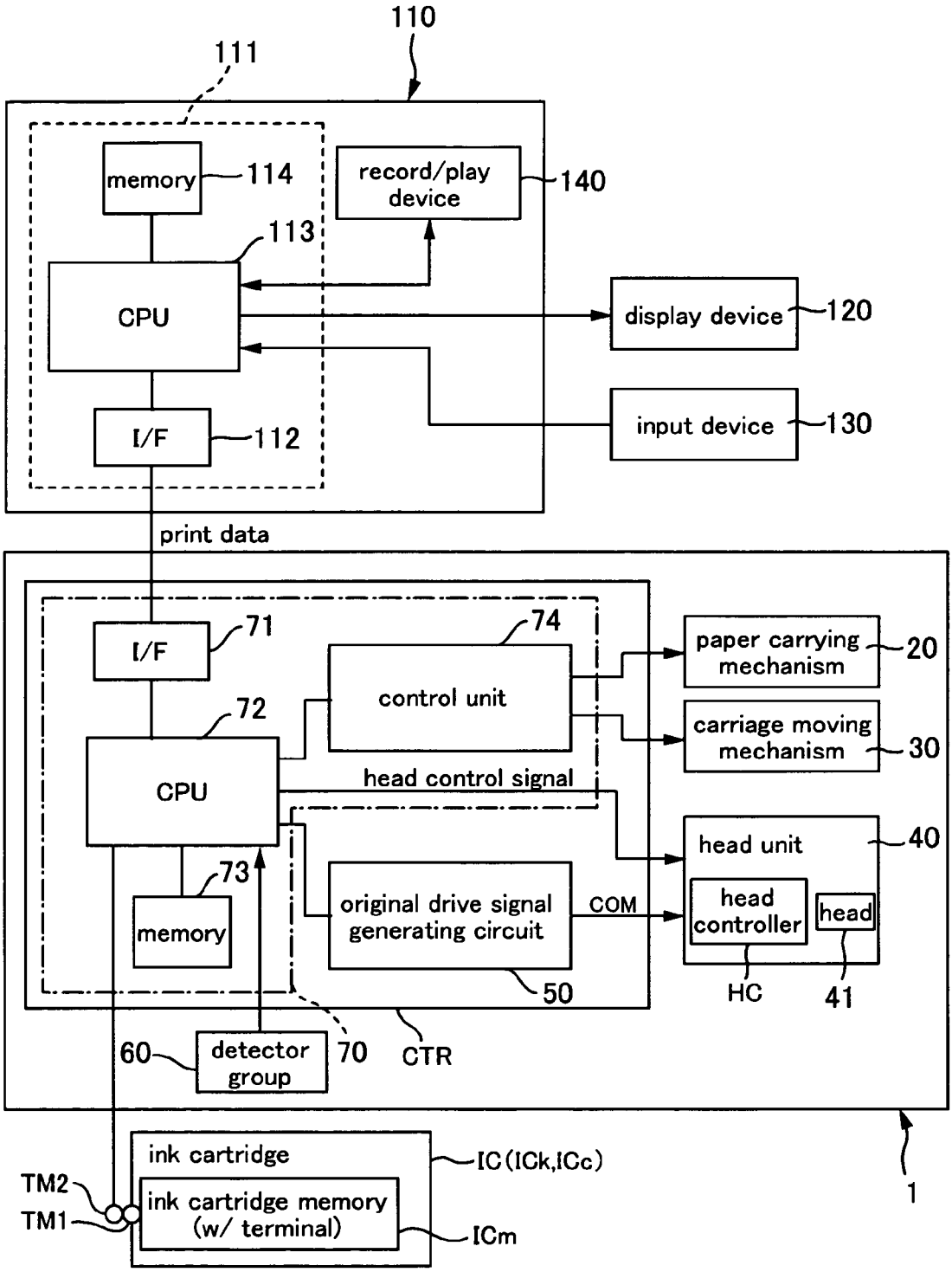
FIG. 2 is a block diagram showing the configuration of a computer and a printer.

FIG. 2 is a block diagram showing the configuration of the computer 110 and the printer 1. First, the configuration of the computer 110 is described briefly. This computer 110 has the record/play device 140 mentioned above and a host-side controller 111. The record/play device 140 is connected communicably to the host-side controller 111 and is attached to an enclosure of the computer 110, for example. The host-side controller 111 performs various controls on the computer 110, and the display device 120 and the input device 130 mentioned above are connected communicably to the host-side controller 111. This host-side controller 111 has an interface section 112, a CPU 113, and a memory 114. The interface section 112 is provided between the computer 110 and the printer 1 and exchanges data therebetween. The CPU 113 is a processing unit for carrying out overall control of the computer 110. The memory 114 is for reserving a work area and a storage area for the computer programs for the CPU 113, and includes storage devices such as a RAM, an EEPROM, a ROM, or a magnetic disk device. As mentioned above, the computer program stored in this memory 114 is an application program, a printer driver or the like. The CPU 113 performs various controls according to the computer program stored in the memory 114.

Figure 6:
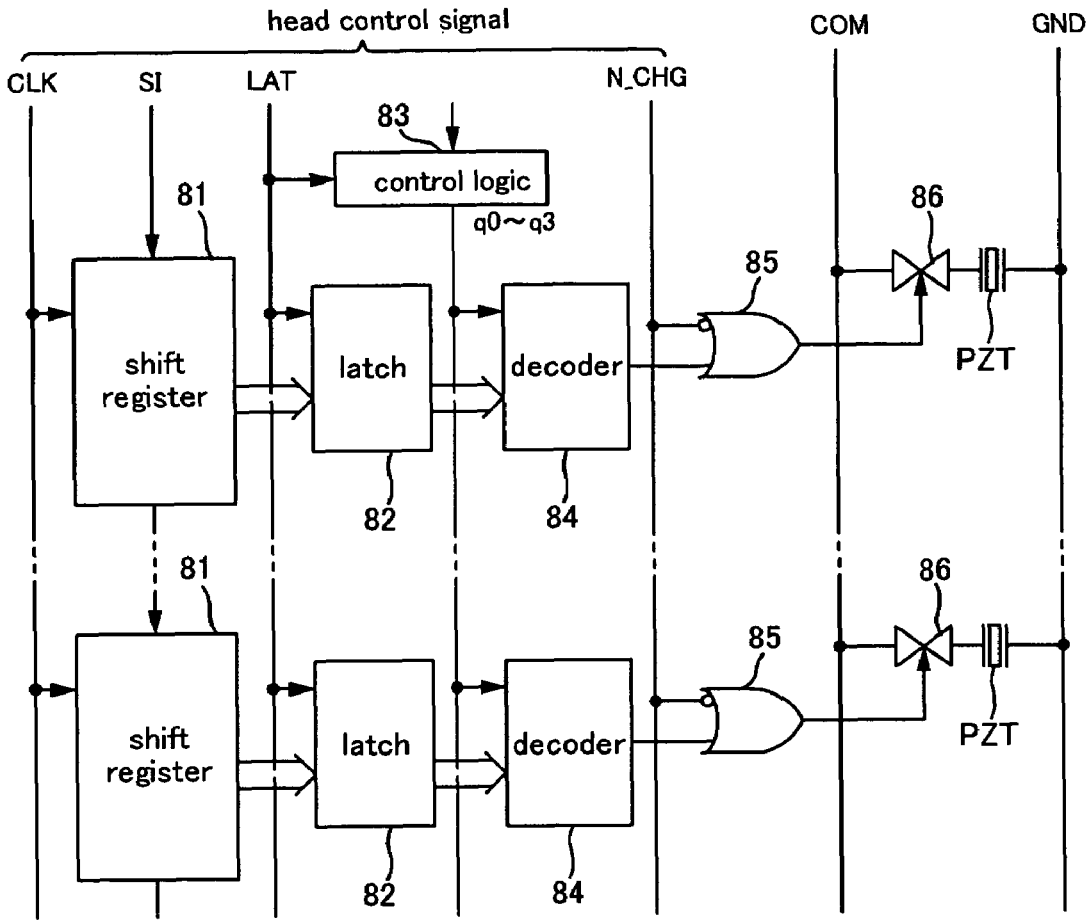
FIG. 6 is a block diagram showing the configuration of a head controller.

The print data is data in a form that can be interpreted by the printer 1, and includes various command data and dot formation data SI (see FIG. 6). The command data is data for instructing the printer 1 to execute a specific operation. Among the command data are, for example, command data for instructing to supply paper, command data for indicating a carry amount, and command data for instructing to discharge paper. The dot formation data SI is data relating to a dot of an image to be printed. Here, the dot is formed corresponding to a virtual square region defined on the paper S (also referred to as a "unit region"). The dot formation data SI consists of tone level data that indicates a tone value. In the present embodiment, the dot formation data SI consists of 2-bit data. Accordingly, among the dot formation data SI are tone level data "00" corresponding to no dot (no ejection of ink), tone level data "01" corresponding to the formation of a small dot, tone level data "10" corresponding to the formation of a medium dot, and tone level data "11" corresponding to the formation of a large dot. In short, in this printer 1, there are four tone values for one unit region.

Printer 1

Regarding Configuration of Printer 1

Figure 3A:
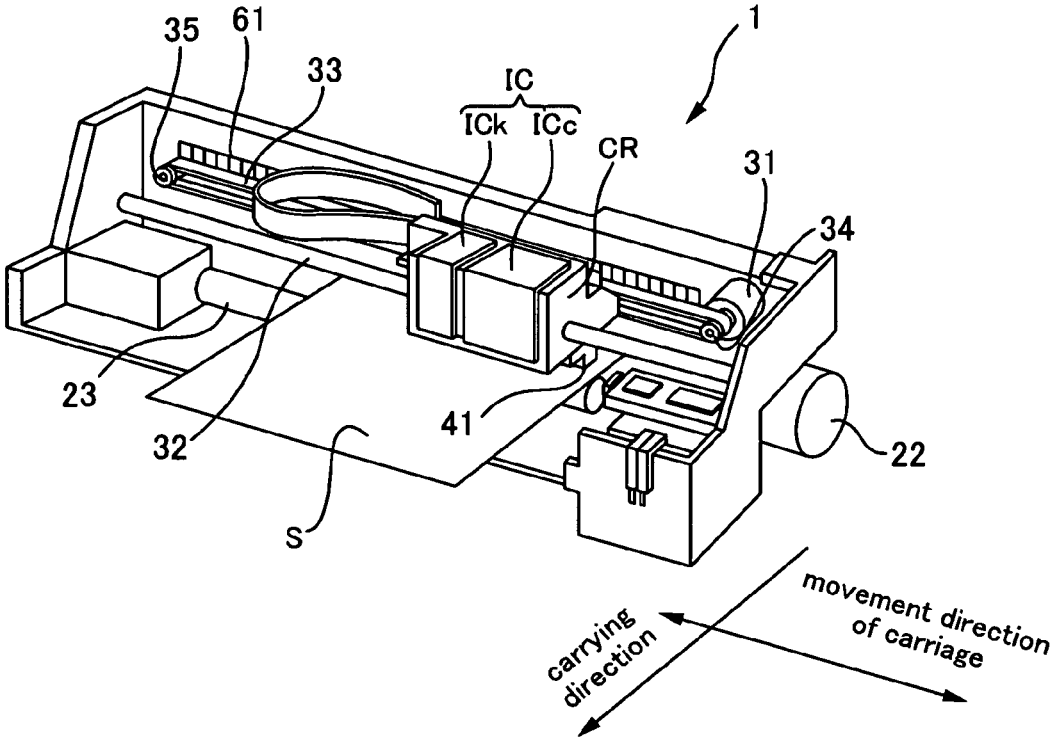
FIG. 3A is a schematic diagram showing the structure of a printer in the present embodiment.
Figure 3B:
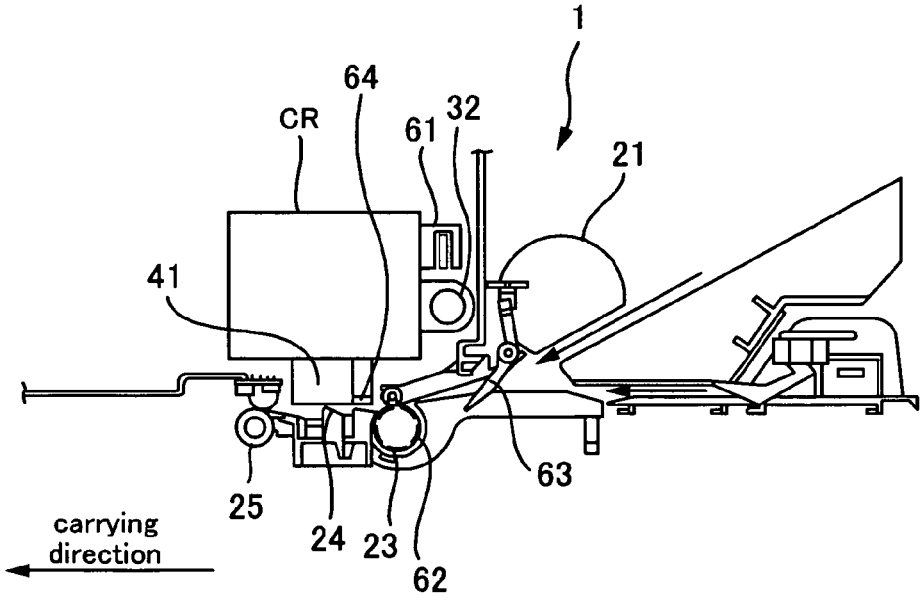
FIG. 3B is a side view showing of the structure of the printer in the present embodiment.

This section below describes the configuration of the printer 1. Here, FIG. 3A is a schematic diagram showing the structure of the printer 1 in the present embodiment. FIG. 3B is a side view showing the structure of the printer 1 in the present embodiment. In the explanation below, FIG. 2 is also referred to. This printer 1 has a paper carrying mechanism 20, a carriage moving mechanism 30, a head unit 40, an original drive signal generating circuit 50, a detector group 60 and a printer-side controller 70, as shown in FIG. 2. The original drive signal generating circuit 50 and the printer-side controller 70 are provided on a common controller board CTR. The head unit 40 also has a head controller HC and a head 41. In the printer 1, the printer-side controller 70 controls control targets such as the paper carrying mechanism 20, the carriage moving mechanism 30, the head unit 40 (the head controller HC and the head 41), and the original drive signal generating circuit 50. That is, the printer-side controller 70 controls the control targets based on print data received from the computer 110 and makes the control targets print an image on the paper S. At that time, each detector of the detector group 60 detects conditions of each section in the printer 1 and outputs a result of the detection to the printer-side controller 70. The printer-side controller 70 receives the result of the detection from each of detectors and controls the control targets based on the result of the detection.

Figure 4A:
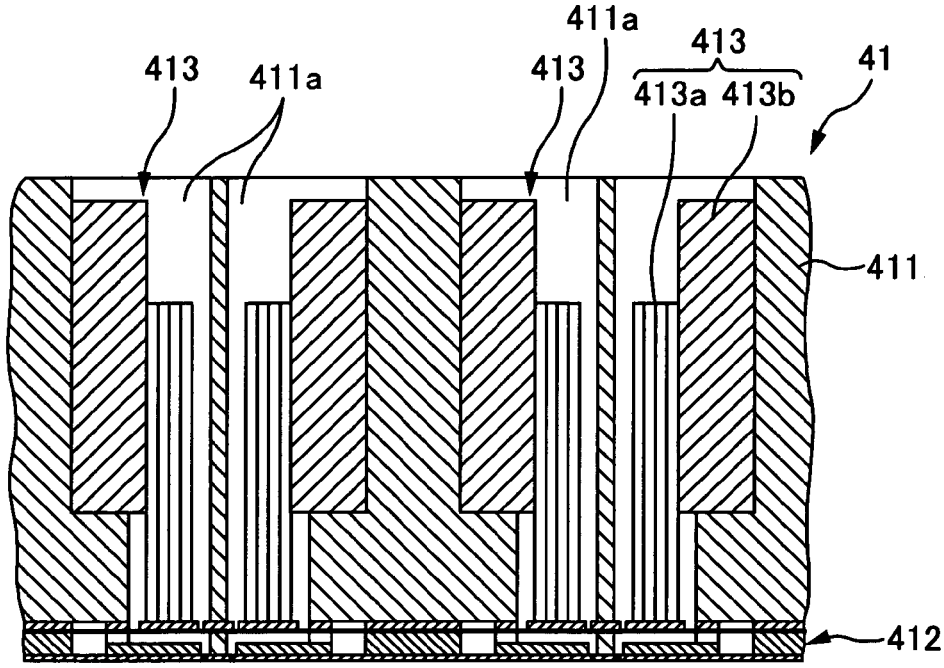
FIG. 4A is a cross-sectional view showing the structure of a head.
Figure 4B:
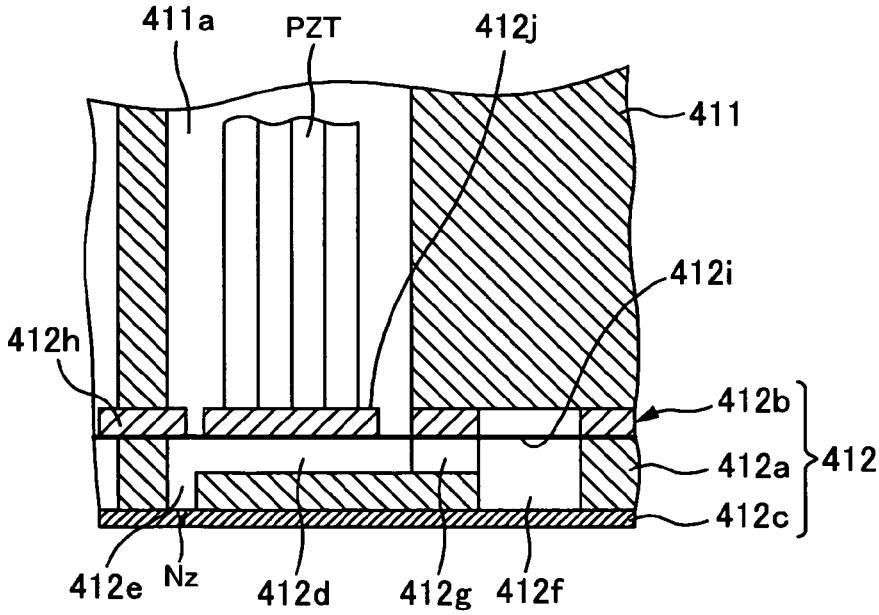
FIG. 4B is a magnified cross-sectional view showing the main section of the head.

In the printer 1, the original drive signal generating circuit 50, the printer-side controller 70 and the head controller HC serve as a drive signal generating section and generate a drive signal which is applied to a piezo element PZT provided in the head 41 (see FIGS. 4A and 4B). The generated drive signal and each section which the drive signal generating section consists of are described in detail later.

Regarding Paper Carrying Mechanism 20

The paper carrying mechanism 20 serves as a medium carry section for carrying a medium. The paper carrying mechanism 20 inserts the paper S as a medium up to a printable position and carries the paper S by a predetermined carry amount in a carrying direction. The carrying direction is a direction intersecting a carriage movement direction described below. As shown in FIGS. 3A and 3B, the paper carrying mechanism 20 has a paper supply roller 21, a carry motor 22, a carry roller 23, a platen 24, and a paper discharge roller 25. The paper supply roller 21 is a roller for supplying, into the printer 1 automatically, the paper S that has been inserted to a paper insert opening, and has a D-shaped cross-section in this example. The carry motor 22 is a motor for carrying the paper S in the carrying direction, and its operation is controlled by the printer-side controller 70. The carry roller 23 is a roller for carrying the paper S which has been supplied by the paper supply roller 21 up to a printable region. The platen 24 is a member for supporting the paper S from below. The paper discharge roller 25 is a roller for carrying the paper S for which printing has ended.

Regarding Carriage Moving Mechanism 30

The carriage moving mechanism 30 is for moving a carriage CR in the carriage movement direction; the carriage CR has the head unit 40 attached thereto. The carriage movement direction includes a movement direction from one side to the other side and a movement direction from that other side to the one side. Since the head unit 40 has the head 41, the carriage movement direction is a head movement direction (a predetermined direction) in which the head 41 moves. The carriage moving mechanism 30 also serves as a head movement section which moves the head 41 in the predetermined direction. This carriage moving mechanism 30 has a carriage motor 31, a guide shaft 32, a timing belt 33, a drive pulley 34, and an idler pulley 35. The carriage motor 31 serves as a driving power source for moving the carriage CR. Operation of the carriage motor 31 is controlled by the printer-side controller 70. The drive pulley 34 is attached to a rotating shaft of the carriage motor 31. The drive pulley 34 is arranged at the one end side of the carriage movement direction. The idler pulley 35 is arranged at the other end side of the carriage movement direction, which is located opposite the drive pulley 34. The timing belt 33 is an annular member whose end section is secured to the carriage CR, and is mounted on and extended between the drive pulley 34 and the idler pulley 35. The guide shaft 32 supports the carriage CR movably. The guide shaft 32 is attached along the carriage movement direction. Accordingly, on operation of the carriage motor 31, the carriage CR moves along the guide shaft 32 in the carriage movement direction and the head 41 also moves in the head movement direction.

An ink cartridge IC in which ink is stored is loaded into the carriage CR. The ink cartridge IC serves as an ink storage container. The ink cartridge IC in the present embodiment has a black ink cartridge ICk in which black ink is stored and a color ink cartridge ICc in which color ink is stored. In the color ink cartridge ICc, five types of inks are stored. Specifically, light cyan ink, dark cyan ink, light magenta ink, dark magenta ink, and yellow ink are stored. Here, a group of light cyan ink and dark cyan ink and a group of light magenta ink and dark magenta ink are groups of light ink and dark ink of the same color. Accordingly, the above-mentioned head 41 ejects six types of ink including black ink in total.

As shown in FIG. 2, the ink cartridge IC is furnished with an ink cartridge memory ICm. The ink cartridge memory ICm serves as a container-side storage section and stores ink-type information indicating types of the stored ink. The ink cartridge memory ICm also stores other information, including consumption-amount information relating to ink consumption. The ink cartridge memory ICm is furnished with a terminal (for convenience of explanation, hereinafter referred to as a memory-side terminal TM1). The memory-side terminal TM1 is in contact with a terminal on a carriage side (for convenience of explanation, hereinafter, referred to as a carriage-side terminal TM2) while the ink cartridge IC is loaded into the carriage CR. The carriage-side terminal TM2 is connected to the printer-side controller 70 (CPU 72) via wiring. Accordingly, while the ink cartridge IC is loaded, the printer-side controller 70 (that is, the drive signal generating section) can obtain the ink type information and the consumption-amount information.

Regarding Head Unit 40

Figure 5:
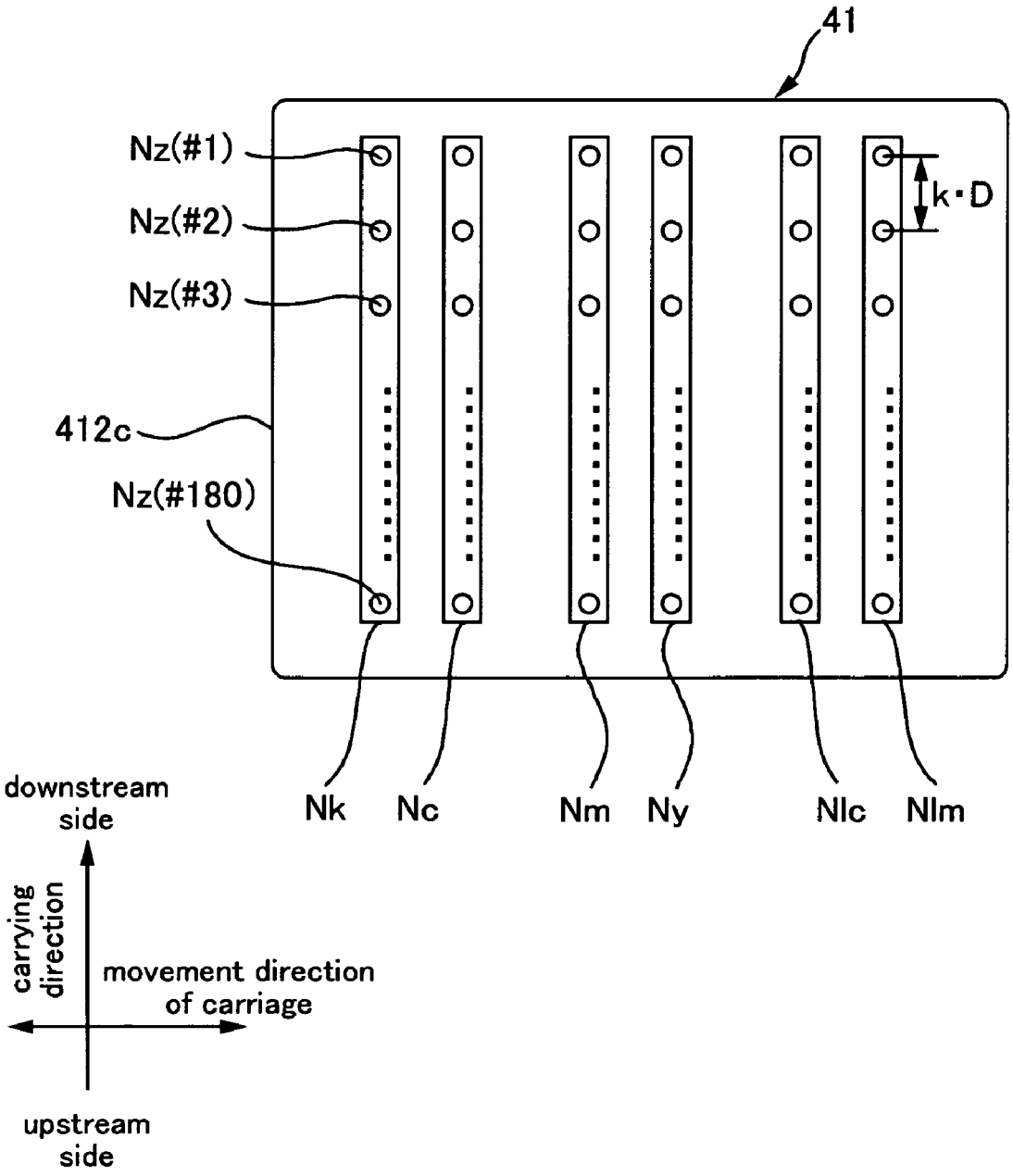
FIG. 5 is an explanatory diagram showing the arrangement of nozzle rows.

The head unit 40 is for ejecting ink to the paper S. This head unit 40 has the head 41 and the head controller HC. Here, FIG. 4A is a cross-sectional view showing the structure of the head 41. FIG. 4B is a magnified cross-sectional view showing the main section of the head 41. FIG. 5 is an explanatory diagram showing the arrangement of nozzle rows. For convenience of explanation, the section below describes the head 41, and the head controller HC is described in detail later.

Regarding Head 41

The head 41 has a case 411, a flow path unit 412, and piezo element units 413. The case 411 is a block-like member in which containment chambers 411*a* for containing the piezo element units 413 are formed. The respective piezo element units 413 are attached for each of nozzle rows. As shown in FIG. 5, there are six nozzle rows (Nk through Nlc) in the head 41. Therefore, the case 411 is furnished with six containment chambers 411*a*, and the six piezo element units 413 are contained respectively in each of the containment chambers 411*a*. Note that FIG. 4A shows a part of the six containment chambers 411*a*.

The flow path unit 412 has a flow-path-forming plate 412*a*, an elastic plate 412*b* which is joined to one surface of the flow-path-forming plate 412*a*, and a nozzle plate 412*c* which is joined to the other surface of the flow-path-forming plate 412*a*. The flow-path-forming plate 412*a* is formed from a silicon wafer, a metal plate, or the like. The flow-path-forming plate 412*a* has groove portions which serve as pressure chambers 412*d*, through openings which serve as nozzle link openings 412*e*, through openings which serve as shared ink chambers 412*f*, and groove portions which serve as ink supply paths 412*g*, formed therein. The elastic plate 412*b* has a support frame 412*h* and island sections 412*j* to which a tip of each piezo element PZT is joined. In the periphery of each island section 412*j*, an elastic region is formed by an elastic film 412*i*.

Each of the piezo element units 413 consists of a piezo element group 413*a* and an adhesive substrate 413*b* . The piezo element group 413*a* is in a comb-teeth shape, and each one of comb teeth is the piezo element PZT. The piezo element group 413*a* has piezo elements PZT the number of which is equivalent to nozzles Nz. The adhesive substrate 413*b* is a rectangular board; the piezo element group 413*a* adheres to one surface of the substrate 413*b*, and the case 411 adheres to the other surface of the substrate 413*b* . The piezo element PZT deforms by applying electric potential difference between opposite electrodes. In this example, the piezo element PZT extends or contracts in a lengthwise direction thereof. An amount of the extension or contraction is determined depending on the electric potential of the piezo element PZT. The electric potential of the piezo element PZT is determined depending on an applied drive signal (shown with solid lines in FIGS. 13 and 14). Accordingly, the piezo element PZT extends or contracts depending on the electric potential of the applied drive signal.

When the piezo element PZT extends or contracts, the island section 412*j* corresponding to the piezo element PZT is pushed towards the pressure chamber 412*d* or is pulled in the opposite direction. At that time, since the elastic film 412*i* around the island section deforms, ink can be ejected efficiently from the nozzle Nz. The piezo element PZT mentioned above serves as an element which performs operation for ejecting ink by being charged/discharged by the drive signal. If the piezo element PZT is used on the head 41, the amount and speed of ink to be ejected can be controlled diversely in accordance with a shape of applied drive pulses PS1 through PS4.

Also, the above-mentioned nozzle plate 412*c* is provided on a paper-facing surface of the head 41. The nozzle plate 412*c* is furnished with a plurality of nozzle rows, each consisting of a plurality of nozzles Nz; the number of the nozzle rows corresponds to the number of the types of ink. Since six types of ink can be ejected in the printer 1 as mentioned above, the number of the nozzle rows is six. In the example shown in FIG. 5, a black ink nozzle row Nk, a cyan ink nozzle row Nc, a magenta ink nozzle row Nm, a yellow ink nozzle row Ny, a light cyan ink nozzle row Nlc, and a light magenta ink nozzle row Nlm are provided in the order from left to right. Each of the nozzle rows is formed parallel to the carrying direction and the nozzle rows are lined up parallel to one another in the carriage movement direction.

Regarding Head Controller HC

This section describes the head controller HC. Here, FIG. 6 is a block diagram showing the configuration of the head controller HC. As mentioned above, the head controller HC constitutes a part of the drive signal generating section. The head controller HC in the present embodiment has shift registers 81, latch circuits 82, a control logic 83, decoders 84, gate circuits 85, and head switches 86. Each of the sections except the control logic 83 (that is, the shift register 81, the latch circuit 82, the decoder 84, the gate circuit 85, and the head switch 86) is provided respectively for each piezo element PZT, in short, for each nozzle Nz. Also, the head controller HC is provided corresponding to each type of ink. Since the printer 1 can eject six types of ink as mentioned above, six of the blocks illustrated in FIG. 6 are provided. The section below describes each of the sections which the head controller HC consists of.

The shift register 81 is a section in which the dot formation data SI from the printer-side controller 70 is set. The latch circuit 82 latches the dot formation data SI set in the shift register 81.

The control logic 83 serves as a switch-operation information storing section, and stores switch-operation information (q0 through q3) according to which operation of the head switch 86 is determined. The control logic 83 outputs the pieces of stored switch-operation information q0 through q3 while changing the level of each piece of switch-operation information at timings determined by a latch signal LAT and a change signal CH (see FIG. 7). In short, the control logic 83 performs outputting chronologically. The control logic 83 stores the switch-operation information corresponding to each type of the dot formation data SI, more specifically, corresponding to the respective tone levels: non-formation of a dot, formation of a small dot, formation of a medium dot, and formation of a large dot. Also, the control logic 83 is provided on each block associated with the type of ink. The switch-operation information stored in each of the control logics 83 is determined associated with types of ink to be ejected, such as switch-operation information for black ink, switch-operation information for light cyan ink, switch-operation information for dark cyan ink, and the like. Accordingly, it should be noted that the control logic 83 stores the switch-operation information corresponding to each of the types of ink and each of the tone values. The switch-operation information stored in the control logic 83 is described later.

The decoder 84 selects one type of the switch-operation information which is determined for each of the tone levels and is outputted by the control logic 83, according to the dot formation data SI latched by the latch circuit 82, and the decoder 84 outputs the selected switch-operation information to the head switch 86 via the gate circuit 85. Here, the switch-operation information outputted by the control logic 83 has not been processed by selection by the decoder 84 and, therefore, can be referred to as "unselected switch-operation information". On the other hand, the switch-operation information applied to the head switch 86 has already been processed by selection by the decoder 84 and, therefore, can be referred to as "selected switch-operation information". Accordingly, the decoder 84 can be deemed to select a certain piece of the unselected switch-operation information corresponding to a certain tone level, from among a plurality of types of the unselected switch-operation information which are outputted simultaneously, and output the certain type of unselected switch-operation information as the selected switch-operation information.

The gate circuit 85 is for applying to the head switch 86 the switch-operation information from the decoder 84 and an N-charge signal N_CHG from the printer-side controller 70. Here, the N-charge signal N_CHG is a forced-application signal for applying a original drive signal COM (see FIG. 7) to all piezo elements PZT in the block and is used for adjusting the electric potential of each piezo element PZT. The N-charge signal N_CHG becomes effective when it is at L-level. Accordingly, when the N-charge signal N_CHG is at H-level, output of the gate circuit 85 changes according to the switch-operation information from the decoder 84. On the other hand, when the N-charge signal N_CHG is at L-level, the output of the gate circuit 85 becomes H-level regardless of the switch-operation information from the decoder 84.

The head switch 86 is a switch operating according to the switch-operation information and N-charge signal N_CHG input via the gate circuit 85. The head switch 86 is arranged between the piezo element PZT and a line for supplying the original drive signal COM; the head switch 86 applies the original drive signal COM to the piezo element PZT in the ON state and cuts off the original drive signal COM in the OFF state. The line for supplying the original drive signal COM is connected to the original drive signal generating circuit 50. Accordingly, in other words, the head switch 86 is arranged between the original drive signal generating circuit 50 and the piezo element PZT. When the N-charge signal N_CHG is at H-level, the head switch 86 changes between the ON/OFF states according to the switch-operation information selected by the decoder 84, and applies to the piezo element PZT a necessary portion of the original drive signal COM (in short, the drive signal). Accordingly, the head switch 86 serves as a switch for generating the drive signal applied to the piezo element PZT, from the original drive signal COM.

Also, sections for controlling the operation of the head switch 86 such as, specifically, the shift register 81, the latch circuit 82, and the decoder 84 serve as a switch controller. The switch controller generates the selected switch-operation information from the dot formation data SI (tone value) and the unselected switch-operation information. The shift register 81, the latch circuit 82, the control logic 83 and the decoder 84 are described later.

Regarding Original Drive Signal Generating Circuit 50

The original drive signal generating circuit 50 generates the original drive signal COM, and serves as an original drive signal generating section. Here, the original drive signal COM is a signal which is a base for the drive signal which is for driving the piezo elements PZT, as mentioned above.

Figure 7:
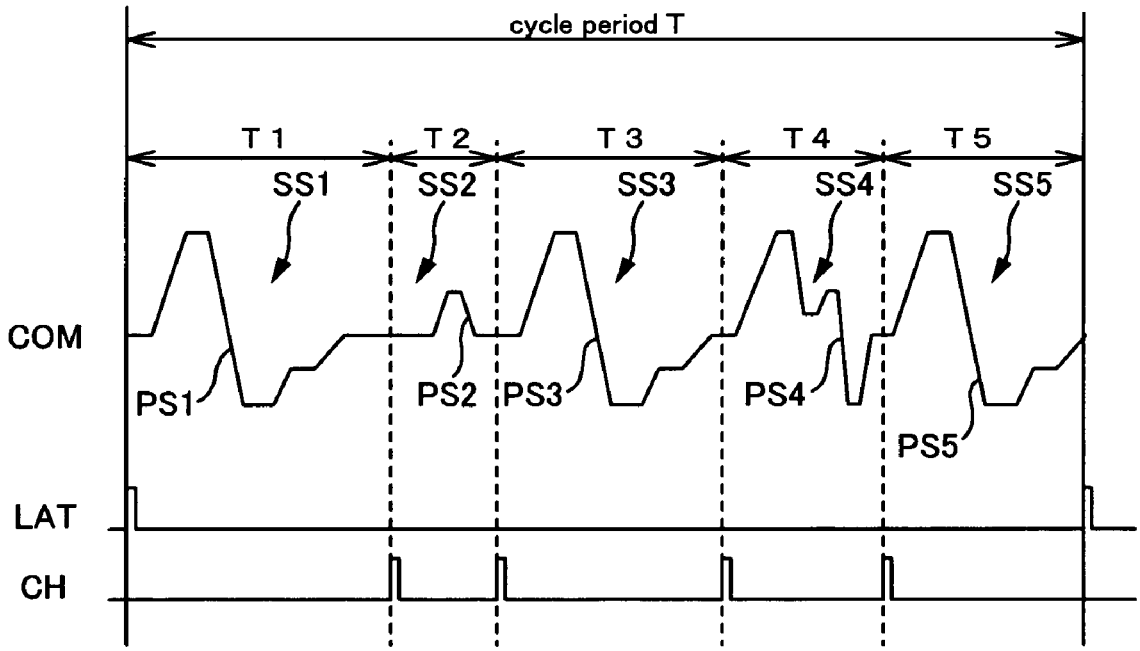
FIG. 7 is a diagram showing an original drive signal.

As shown in FIG. 7, the original drive signal COM is generated repeatedly every cycle period T. The cycle period T can be divided into five periods T1 through T5. The original drive signal COM has a first-period signal SS1 generated in a first period T1, a second-period signal SS2 generated in a second period T2, a third-period signal SS3 generated in a third period T3, a fourth-period signal SS4 generated in a fourth period T4, and a fifth-period signal SS5 generated in a fifth period T5. The first-period signal SS1 has a drive pulse PS1. Also, the second-period signal SS2 has a drive pulse PS2 and the third-period signal SS3 has a drive pulse PS3 respectively. In addition, the fourth-period signal SS4 has a drive pulse PS4 and the fifth-period signal SS5 has a drive pulse PS5 respectively. These drive pulses PS1 through PS5 serve as waveform sections for operating the piezo element PZT, and their respective shapes are determined based on the operation performed by the piezo element PZT.

The drive pulse PS1, the drive pulse PS3, the drive pulse PS4, and the drive pulse PS5 are the waveform sections which are used when ink is ejected from the nozzle Nz. Among these drive pulses, all of the drive pulse PS1, the drive pulse PS3, and the drive pulse PS5 have the same waveform. When any one of the drive pulses PS1, PS3, and PS5 is applied to the piezo element PZT, ink of an amount corresponding to a medium dot is ejected from the nozzle Nz. For example, 7 pl (7 ng) of ink is ejected. When the ink lands on the paper S, a medium dot is formed in a unit region of the paper S. In addition, when any two or all of these drive pulses PS1, PS3, and PS5 are applied to the piezo element PZT, ink of an amount corresponding to a large dot (14 pl or 21 pl) is ejected from the nozzle Nz and a large dot is formed on the paper S.

For convenience of explanation, the drive pulse PS1, the drive pulse PS3, and the drive pulse PS5 are also referred to as medium-dot pulses. Furthermore, the drive pulse PS1 is referred to as a first medium-dot pulse, the drive pulse PS3 is referred to as a second medium-dot pulse, and the drive pulse PS5 is referred to as a third medium-dot pulse. The number of the drive pulses to be used on formation of the large dot (two or three) is determined depending on the type of ink. This point is described later.

The drive pulse PS4 is a drive signal which is applied to the piezo element PZT when a small dot is formed. In short, when the drive pulse PS4 is applied to the piezo element PZT, ink of an amount corresponding to a small dot is ejected from the nozzle Nz. In this example, 2 pl (2 ng) of ink is ejected. When the ink lands on the paper S, a small dot is formed. For convenience of explanation, the drive pulse PS4 is also referred to as a small-dot pulse.

On the other hand, the drive pulse PS2 is a pulse for causing micro-oscillation of a meniscus (a free surface of ink in the nozzle which is exposed to outside air). In other words, when the drive pulse PS2 is applied to the piezo element PZT, fluctuation in the pressure occurs on the ink in the pressure chamber 412*d* to the extent that ink is not ejected. Therefore, the meniscus changes in its position in the nozzle Nz and ink near the nozzle Nz is stirred. For convenience of explanation, the drive pulse PS2 is referred to as a micro-oscillation pulse.

Figure 8:
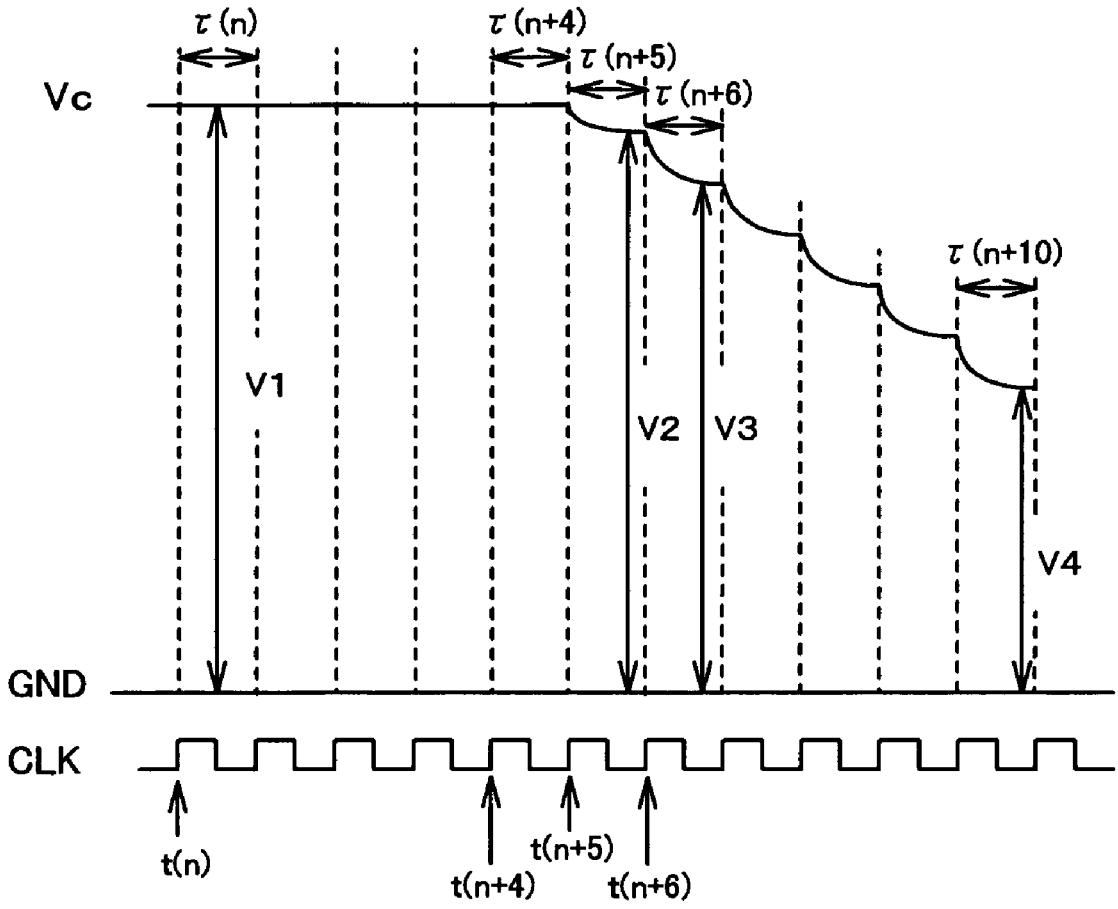
FIG. 8 is a chart illustrating the concept of the generating operation of an original drive signal.

The original drive signal COM mentioned above is outputted by the original drive signal generating circuit 50, based on drive signal generation information from the printer-side controller 70. The section below describes generating operation of the original drive signal COM by the original drive signal generating circuit 50. FIG. 8 is a chart illustrating the concept of the generating operation of the original drive signal COM.

The printer-side controller 70 obtains an output voltage for each refresh cycle period $\tau$ based on a parameter for generating the original drive signal COM. In case of generation of the original drive signal COM, the printer-side controller 70 obtains a DAC value corresponding to the output voltage (for example, information indicating the output voltage in the form of a 10-bit digital value), and outputs the obtained DAC value to the original drive signal generating circuit 50 every refresh cycle period $\tau$. In the example of FIG. 8, the DAC value corresponding to voltage V1 is outputted at intervals of timing t (n) determined by a clock signal CLK. As a result thereof, in the refresh cycle period $\tau$ (n), the output of the original drive signal generating circuit 50 is voltage V1. Since, until refresh cycle period $\tau$ (n+4), the DAC value corresponding to voltage V1 is outputted in sequence, the original drive signal generating circuit 50 continues to output voltage V1. In addition, at the timing t (n+5), the DAC value corresponding to voltage V2 is outputted. As a result thereof, in the refresh cycle period $\tau$ (n+5), output of the original drive signal generating circuit 50 declines from voltage V1 to voltage V2. Also, at the timing $\tau$ (n+6), the DAC value corresponding to voltage V3 is outputted. As a result thereof, in the refresh cycle period $\tau$ (n+6), output of the original drive signal generating circuit 50 declines from voltage V2 to voltage V3. Since the DAC value is outputted in the same way mentioned above, the voltage outputted from the original drive signal generating circuit 50 declines gradually. In the refresh cycle period $\tau$ (n+10), output of the original drive signal generating circuit 50 becomes voltage V4. A terminal of the original drive signal generating circuit 50 on the non-outputting side is grounded. Accordingly, a terminal on the outputting side is at an electric potential corresponding to the output voltage.

Regarding Detector Group 60

The detector group 60 is for monitoring conditions of the printer 1. As shown in FIGS. 3A and 3B, the detector group 60 includes a linear encoder 61, a rotary encoder 62, a paper detector 63, and a paper width detector 64. The linear encoder 61 is for detecting the position of the carriage CR in the carriage movement direction. The rotary encoder 62 is for detecting an amount of rotation of the carry roller 23. The paper detector 63 is for detecting the paper S to be printed. The paper width detector 64 is for detecting a width of the paper S to be printed.

Regarding Printer-Side Controller 70

The printer-side controller 70 controls each section provided on the printer 1. For example, the printer-side controller 70 makes the printer print an image on the paper S by making the sections of the printer alternately perform an operation in which the paper S is carried by the predetermined carry amount and an operation in which ink is ejected intermittently while the carriage CR (the head 41) is moving. Therefore, the printer-side controller 70 controls carrying of the paper S by controlling the amount of rotation of the carry motor 22. The printer-side controller 70 also controls movement of the carriage CR by controlling rotation of the carriage motor 31. In addition, the printer-side controller 70 controls ejection of ink by outputting the dot formation data SI to the head controller HC. As mentioned above, the dot formation data SI is used when generating from the original drive signal COM the drive signal applied to the piezo element PZT. In addition, the printer-side controller 70 controls output of the DAC value as information designating voltage to the original drive signal generating circuit 50. In this way, the printer-side controller 70 performs control for generating the original drive signal COM and control for generating the drive signal applied to the piezo element PZT from that original drive signal COM. Therefore, the printer-side controller 70 together with the original drive signal generating circuit 50, the head switch 86 and the head controller HC constitutes the drive signal generating section.

The printer-side controller 70 has an interface section 71, a CPU 72, a memory 73, and a control unit 74, as shown in FIG. 2. The interface section 71 exchanges data between the computer 110, which is an external device, and the printer-side controller 70. The CPU 72 is a processing unit for carrying out overall control of the printer 1. The memory 73 is for reserving a work area and a storage area for the programs for the CPU 72, for instance, and includes storage devices such as a RAM, an EEPROM, a ROM or the like. The CPU 72 controls each of the control targets in accordance with the computer programs stored in the memory 73. For example, the CPU 72 controls, via the control unit 74, the paper carrying mechanism 20, the carriage moving mechanism 30 and the like. For example, the CPU 72 outputs a control signal which is for the carry motor 22, the carriage motor 31 or the like. Also, the CPU 72 outputs to the head controller HC a head control signal (a clock signal CLK, dot formation data SI, a latch signal LAT, a change signal CH, and an N-charge signal N_CHG, for example; see FIG. 6) for controlling operation of the head 41, and the CPU 72 outputs the DAC value for generating the original drive signal COM to the original drive signal generating circuit 50.

Printing Operation

Overview of Printing Operation in the Present Embodiment

This section describes the overview of printing operation in a printing system 100. As mentioned above, a printer 1 provided in the printing system 100 can perform printing in each unit region using a plurality of types of tone levels. Specifically, the printer 1 can perform printing in the region using any of four tone levels: non-formation of a dot, formation of a small dot, formation of a medium dot, and formation of a large dot. Here, in case of light ink and dark ink of a same color, when a same amount of ink is used for a large dot, there is variation in the perceived size, even among dots formed with the same amount of ink. Specifically, a dot formed with light ink is perceived larger than a dot formed with dark ink. As a result thereof, difference in size between a medium dot and a large dot varies depending on whether the dots are formed using light ink or dark ink. The variation in the difference in size between dots causes graininess to deteriorate. (For example, the graininess becomes different depending on the type of ink used, which gives rise to deterioration in image quality.) More specifically, the difference in size between a medium dot and a large dot which are formed with light ink is excessively greater than the difference in size between a medium dot and a large dot which are formed with dark ink, and this causes graininess to deteriorate.

In the embodiment, regarding a color to be printed with light ink or dark ink, the size of a dot is optimized by using a different drive signal corresponding to a tone value of a large dot (a "specific tone value") between light ink and dark ink. As a result thereof, the difference in size between a medium dot and a large dot which are formed with light ink can be made equal to the difference in size between a medium dot and a large dot which are formed with dark ink, and graininess can be improved (for example, the graininess can be made uniform between the different types of inks used) in an image to be printed with light ink and dark ink. The section below describes these points in detail.

Regarding Printing Operation

When, in the illustrated printing system 100, an image is printed on a paper S, a process for generating print data and a process for printing the image on the paper S based on the print data are performed. The process for generating the print data is performed by a computer 110 of the printing system 100. In other words, a CPU 113 of a host-side controller 111 operates according to a computer program stored in a memory 114 and performs the process. Accordingly, the computer program contains codes for performing each process. Also, the process for printing the image on the paper S is performed by the printer 1 of the printing system 100. In other words, a CPU 72 of a printer-side controller 70 operates according to a computer program stored in a memory 73 and performs the process. Accordingly, the computer program contains codes for performing each process.

Regarding Process for Generating Print Data

Figure 9:
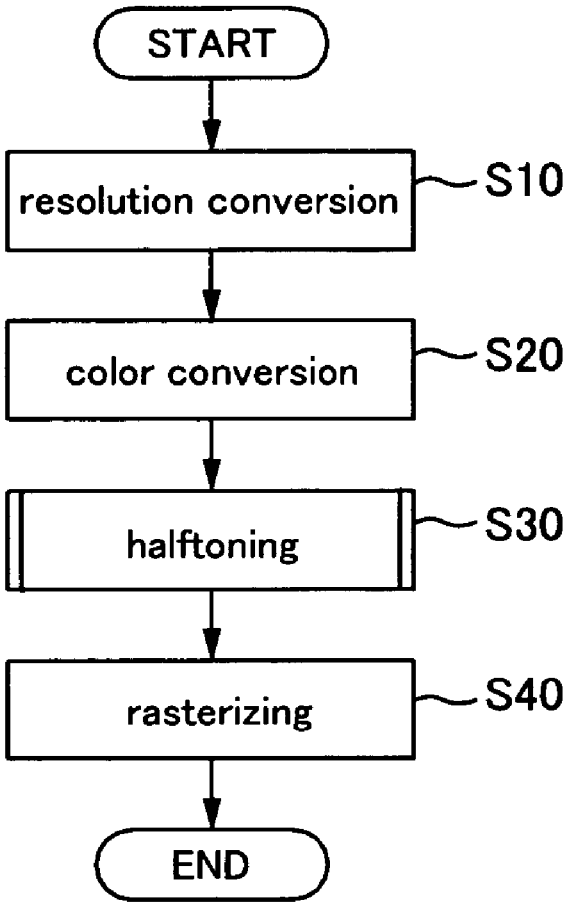
FIG. 9 is a flowchart showing processes in print data generation.

First, this section describes the process for generating print data. Here, FIG. 9 is a flowchart showing processes in print data generation. As shown in FIG. 9, in print data generation, resolution conversion (S10), color conversion (S20), halftoning (S30), and rasterizing (S40) are performed.

The resolution conversion is a process for converting image data (text data, picture data, and the like) into resolution with which the image is to be printed on the paper S (this is the spacing between dots in printing and is also referred to as "print resolution"). The color conversion is a process for converting each piece of RGB pixel data in RGB image data into data having multiple levels of tone values which are expressed in the CMYK color space (256 tone levels, for example). The color conversion is performed by referring to a table in which RGB tone values are associated with CMYK tone values (Color Conversion Lookup Table).

Halftoning is a process for converting CMYK pixel data having multiple levels of tone values into data having fewer levels of tone values that can be formed by the printer 1. In other words, the halftoning is a process for obtaining dot formation data SI from the CMYK pixel data having multiple levels of tone values. The halftoning enables to obtain 2-bit dot formation data SI having 4-level tone values from CMYK pixel data having 256-level tone values, for example.

Figures 10A, 10B:
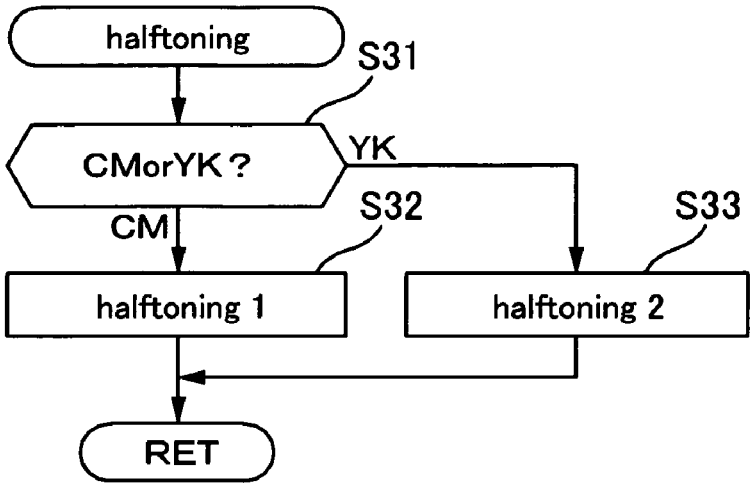
FIG. 10A is a flowchart showing a selection routine in halftoning.
FIG. 10B is a table which shows, for each color of ink, types of halftoning to be selected by the selection routine.
Figure 11:
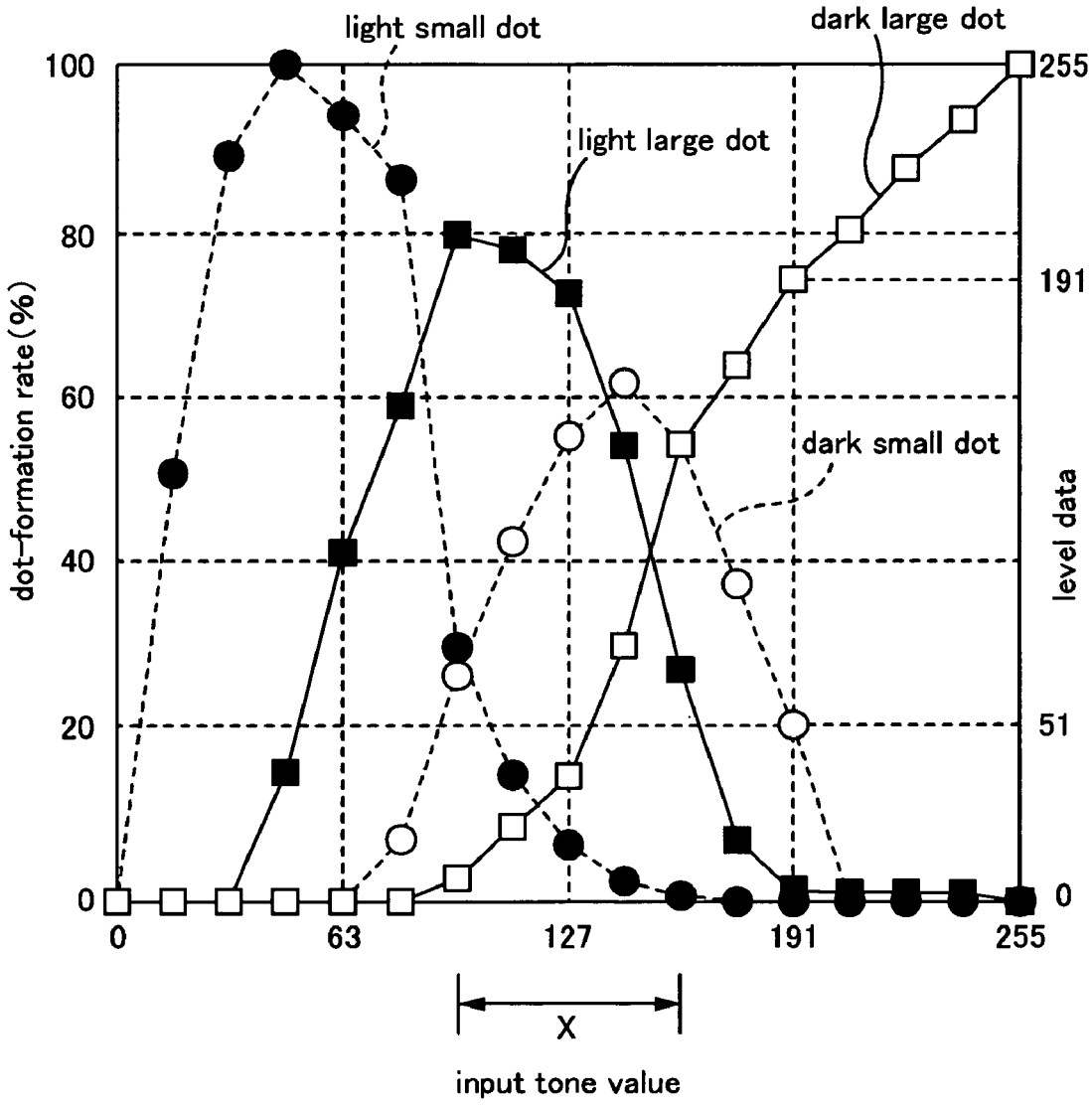
FIG. 11 is a chart illustrating the concept of first halftoning.

Here, FIG. 10A is a flowchart showing a selection routine in halftoning. FIG. 10B is a table which shows, for each color of ink, types of halftoning to be selected by the selection routine. FIG. 11 is a chart illustrating the concept of first halftoning. As shown in FIGS. 10A and 10B, in the printing system 100, two types of halftoning exist. The first halftoning is a process selected in case of a color for which printing is performed with light ink and dark ink of the same color. In short, the first halftoning is a process selected in case of cyan and magenta. The second halftoning is a process selected in case of a color for which printing is performed with ink in single density. In short, the second halftoning is a process selected in case of yellow and black. These processes are described later.

Rasterizing is a process for rearranging the order of the dot formation data SI obtained by the halftoning into the order of transmission to the printer 1. The rasterized dot formation data SI is outputted to the printer 1 as print data, together with the above-mentioned command data.

Regarding Halftoning

As mentioned above, among the halftoning are the first halftoning for cyan and magenta and the second halftoning for yellow and black.

The first halftoning determines whether, in one unit region, a small dot, a medium dot, or a large dot is to be formed with light ink or dark ink (for convenience of explanation, each type of dot is referred respectively to as a "light small dot", a "light medium dot", a "light large dot", a "dark small dot", a "dark medium dot", or a "dark large dot"), or otherwise a plurality of dots are to be overprinted in the unit region or no dot is to be formed, to obtain the dot formation data SI.

The first halftoning is described below based on an example of FIG. 11. For convenience of explanation, FIG. 11 shows an example in which tone levels are represented with four types of dots: a light small dot, a light large dot, a dark small dot, and a dark large dot. Though, other than these dots, a light medium dot and a dark medium dot are used in the present embodiment, the present embodiment is explained below using the example of four types of dots because the concept is the same. In this FIG. 11, the horizontal axis shows input tone values, that is, corresponds to the 256-level CMYK pixel data which is to be converted. The left vertical axis shows the dot-formation rate. This dot-formation rate is a probability at which each type of dots is formed in a targeted unit region. The right vertical axis shows values of level data corresponding to the dot-formation rate.

In the first halftoning, when a certain tone value is input, the host-side controller 111 decides whether to form a dot or not to form a dot, in the order of a dark large dot, a dark small dot, a light large dot, and a light small dot. For example, if an input tone value (the horizontal axis) of a certain unit region is 191, the dot-formation rate of a dark large dot is approximately 75% and a value of level data is 191. When comparing the value of the level data to a predetermined threshold determined based on a dither matrix, if the value of the level data is greater than the threshold, the host-side controller 111 decides to form a dark large dot. In this case, tone level data "11" indicating formation of a large dot is determined as the dot formation data SI regarding dark ink. On the other hand, if the value of the level data is equal to or smaller than the threshold, non-formation of a dark large dot is decided and then formation/non-formation of a dark small dot is to be decided. More specifically, the controller obtains a value of the level data, 51, corresponding to the dot-formation rate 20%, and compares the value of the level data to the predetermined threshold determined based on the dither matrix. If the value of the level data is greater than the threshold, formation of a dark small dot is decided, and if the value of the level data is equal to or smaller than the threshold, non-formation of a dark small dot is decided. If formation of a dark small dot is decided, tone level data "01" indicating formation of a small dot is determined as the dot formation data SI regarding dark ink. If non-formation of a dark small dot is decided, formation/non-formation of a light large dot and formation/non-formation of a light small dot are also decided in the same manner. Note that, in case of input tone values within a range indicated by a symbol X in the example shown in FIG. 11, there are cases in which a dot with dark ink (a dark large dot or a dark small dot) and a dot with light ink (a light large dot or a light small dot) are overprinted in one unit region.

In the second halftoning, formation of a small dot, a medium dot, or a large dot, or non-formation of a dot is determined regarding each unit region, and dot formation data SI is obtained. A basic concept of the second halftoning is the same as that of the first halftoning. Describing briefly, regarding an input tone value of a certain unit region, level data of a large dot is obtained and a value of the level data is compared to a predetermined threshold determined based on the dither matrix. Here, if the value of the level data is greater than the threshold, formation of a large dot is decided, and tone level data "11" indicating formation of a large dot is determined. On the other hand, if non-formation of a large dot is decided, the same process is performed for a medium dot. Here, if formation of a medium dot is decided, tone level data "10" indicating formation of a medium dot is determined. If non-formation of a medium dot is decided, the same process is performed for a small dot. Here, if formation of a small dot is decided, tone level data "01" indicating formation of a small dot is determined, or if non-formation of a small dot is decided, tone level data "00" indicating non-formation of a dot is determined.

When data indicating formation/non-formation of a dot is determined for all unit regions in the first halftoning and the second halftoning, halftoning is ended.

Regarding Process for Printing Image on Paper S

This section describes a process which is performed by the printer 1 for printing an image on the paper S. Here, FIG. 12A is a flowchart showing the processing during printing. FIG. 12B is a table which shows, for each type of ink and for each of the tone values, drive pulses applied to the piezo element PZT.

As shown in FIG. 12A, in the process for printing an image on the paper S, operation of receiving a print command (S110), paper supply operation (S120), dot forming operation (S130), carrying operation (S140), paper discharge determination (S150), paper discharge operation (S160), and print ending determination (S170) are performed.

In the operation of receiving a print command, the printer-side controller 70 receives a print command from the computer 110 via an interface section 71. The print command is included in print data transmitted from the computer 110. The paper supply operation is operation for moving the paper S to be printed and positioning the paper S at a print start position (that is, an indexed position). In this paper supply operation, the printer-side controller 70 carries the paper S to be printed to a carry roller 23 by rotating a paper supply roller 21. Next, the printer-side controller 70 positions the paper S carried from the paper supply roller 21 at the print start position by rotating the carry roller 23. The dot forming operation is operation for forming dots on the paper S by ejecting ink intermittently from a head 41 which moves in a carriage movement direction. The printer-side controller 70 moves a carriage CR in the carriage movement direction by driving a carriage motor 31. Also, while the carriage CR is moving, the printer-side controller 70 causes the head 41 (nozzle Nz) to eject ink in accordance with the dot formation data SI. As mentioned above, a dot is formed on the paper S when ink ejected from the head 41 lands on the paper S. Note that the dot forming operation is described in detail later. The carrying operation is operation for moving the paper S relative to the head 41 in the carrying direction. The printer-side controller 70 carries the paper S in the carrying direction by rotating the carry roller 23. This carrying operation enables the head 41 to form a dot at a position which is different from the position of the dot formed in the preceding dot forming operation. The paper discharge determination is a process for determining whether or not to discharge the paper S being printed. This determination is performed based on presence or absence of the print data. More specifically, the printer-side controller 70 checks presence or absence of the print data to be printed on the paper S being printed, and determines not to discharge the paper if there remains the print data. In this case, the printer-side controller 70 gradually prints an image consisting of dots on the paper S by alternately repeating the dot forming operation and the carrying operation until there is no more print data to be printed. The printer-side controller 70 determines to discharge the paper if there is no more print data, and discharges the printed paper S out of the printer by rotating a paper discharge roller 25. It should be noted that whether or not to discharge the paper can also be determined based on a paper discharge command included in the print data. The print ending determination is determination on whether or not to continue printing. In this determination, the printer-side controller 70 checks presence or absence of the print data. If a next sheet of the paper S is to be printed, the printer-side controller 70 performs the paper supply operation for the next sheet of the paper S. If the next sheet of the paper S is not to be printed, the printing operation is terminated.

Regarding Dot Forming Operation

Figure 13:
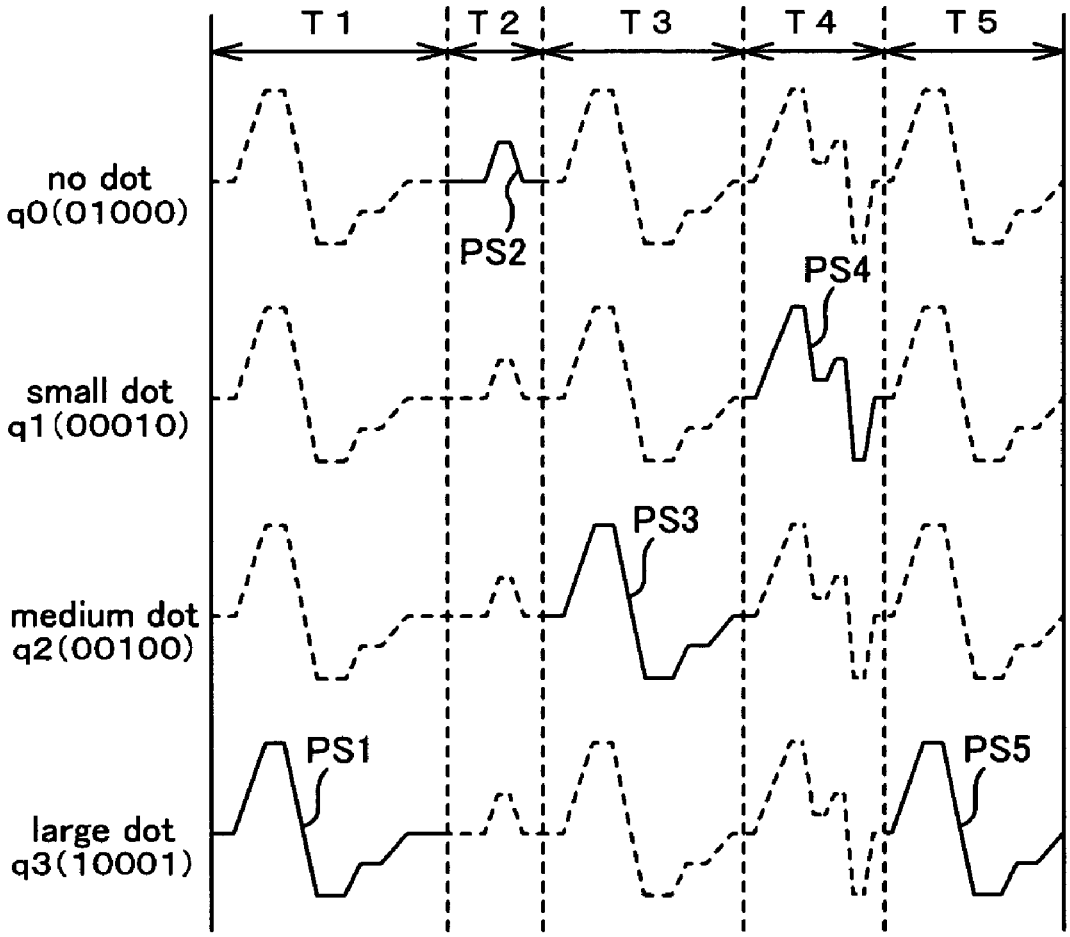
FIG. 13 is a chart illustrating drive signals applied to a piezo element in case of light cyan ink or light magenta ink.
Figure 14:
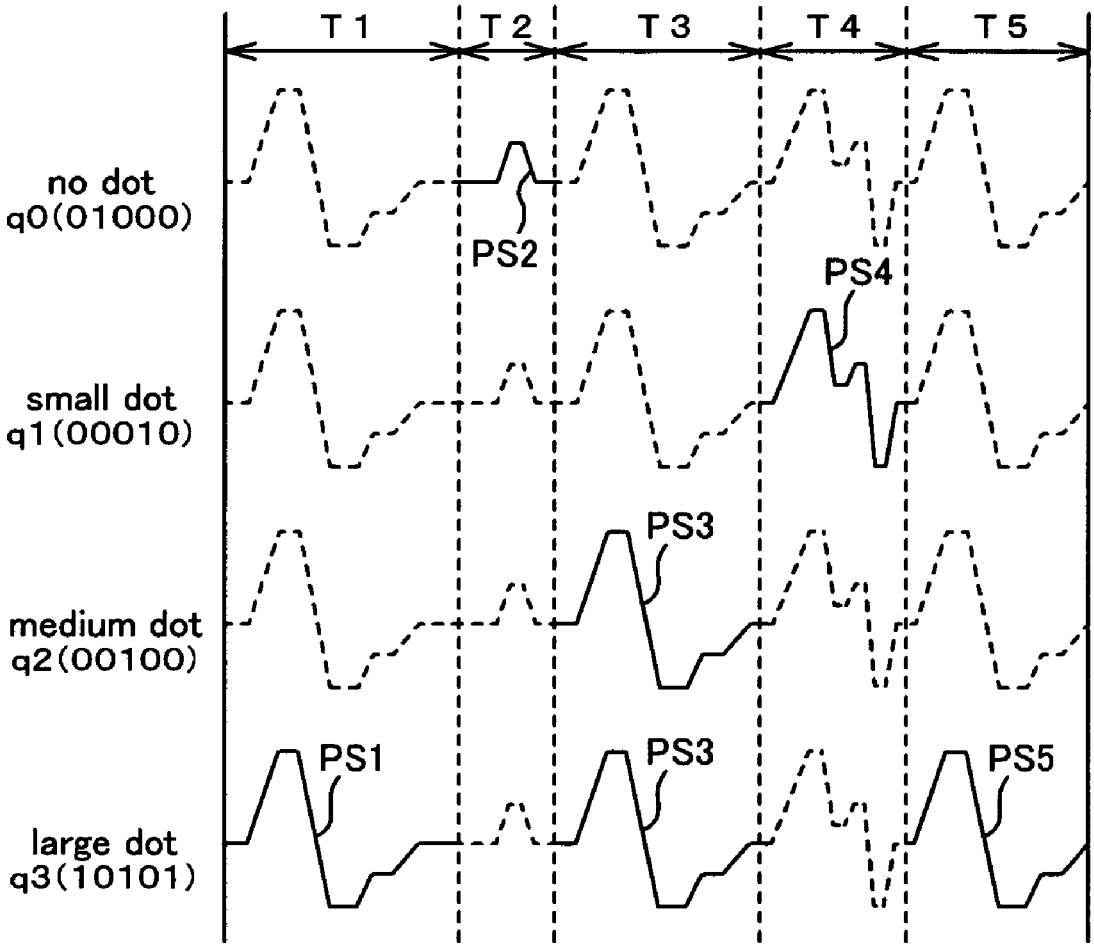
FIG. 14 is a chart illustrating drive signals applied to a piezo element in case of dark cyan ink or dark magenta ink, or yellow ink or black ink.

This section describes the dot forming operation in detail. Here, FIG. 13 is a chart illustrating the drive signals applied to a piezo element PZT in case of light cyan ink or light magenta ink. FIG. 14 is a chart illustrating the drive signals applied to a piezo element PZT in case of dark cyan ink or dark magenta ink or yellow ink or black ink.

In the dot forming operation, the printer-side controller 70 outputs a DAC value to an original drive signal generating circuit 50, and the original drive signal generating circuit 50 outputs to a head unit 40 a voltage signal corresponding to the DAC value. More specifically, the original drive signal generating circuit 50 generates an original drive signal COM according to a voltage specified by the DAC value. The generation of the original drive signal COM is performed repeatedly every time when a latch signal LAT changes to H-level. As a result thereof, the original drive signal COM illustrated in FIG. 7 is generated repeatedly at every cycle period T.

The printer-side controller 70 transmits to a head controller HC the dot formation data SI included in the print data. In addition, the printer-side controller 70 outputs a latch signal LAT and a change signal CH to the head controller HC at a predetermined timing. As mentioned above, in the head controller HC, the dot formation data SI transmitted from the printer-side controller 70 is set in a shift register 81 sequentially. A latch circuit 82 latches the dot formation data SI corresponding thereto at a timing of receiving the latch signal LAT (at a timing when the latch signal LAT changes to H-level).

The latch signal LAT is also input to a control logic 83 of the head controller HC. In addition, the change signal CH is input to the control logic 83. The control logic 83 outputs switch-operation information which is determined for each type of ink and each tone value. More specifically, the control logic 83 refreshes the content of the switch-operation information and outputs the switch-operation information at a timing when the latch signal LAT or the change signal CH changes to H-level.

Here, the switch-operation information is described. As shown in FIG. 13, in case of switch-operation information used for light cyan ink and light magenta ink (for convenience of explanation, also referred to as "light-ink-specific switch-operation information"), switch-operation information q0 corresponding to a tone value of non-ejection (tone level data "00") contains data "01000" and switch-operation information q1 corresponding to a tone value of a small dot (tone level data "01") contains data "00010". In the same way, switch-operation information q2 corresponding to a tone value of a medium dot (tone level data "10") contains data "00100", and switch-operation information q3 corresponding to a tone value of a large dot (tone level data "11") contains data "10001". On the other hand, as shown in FIG. 14, in case of switch-operation information used for dark cyan ink, dark magenta ink, yellow ink, and black ink (for convenience of explanation, also referred to as "dark-ink-specific switch-operation information"), switch-operation information q0 corresponding to a tone value of non-ejection contains data "01000" and switch-operation information q1 corresponding to a tone value of a small dot contains data "00010". In the same way, switch-operation information q2 corresponding to a tone value of a medium dot contains data "00100" and switch-operation information q3 corresponding to a tone value of a large dot contains data "10101".

In comparison between the light-ink-specific switch-operation information and the dark-ink-specific switch-operation information, contents thereof are identical in case of switch-operation information q0 through q2 corresponding respectively to tone values of non-ejection, a small dot, and a medium dot. However, contents of switch-operation information q3 corresponding to a tone value of a large dot are different. In other words, only in case of a tone value of a largest dot (a "specific tone value"), contents are different. Specifically, as shown in FIG. 12B, the light-ink-specific switch-operation information q3 is for applying to the piezo element PZT a first drive signal (a first medium-dot pulse) and a fifth drive signal (a third medium-dot pulse). On the other hand, the dark-ink-specific switch-operation information q3 is for applying to the piezo element PZT the first drive signal (the first medium-dot pulse), a third drive signal (a second medium-dot pulse), and the fifth drive signal (the third medium-dot pulse). In short, regarding a tone value of a largest dot, an amount of ink ejected based on the light-ink-specific switch-operation information q3 is smaller than an amount of ink ejected based on the dark-ink-specific switch-operation information q3. The amount of ink ejected is made different between light ink and dark ink for the tone value of a largest dot in order to effectively suppress deterioration of graininess which is especially conspicuous in formation of a largest dot (this point is described later).

These pieces of switch-operation information are stored in the control logic 83 and contents thereof are transmitted by the printer-side controller 70. For example, switch-operation information is refreshed at every cycle period T together with the above-mentioned dot formation data SI. In this case, the printer-side controller 70 has to recognize the type of ink to be ejected and cause dot formation data SI appropriate to the control logic 83 to be stored. Here, as mentioned above, in the present embodiment, the printer-side controller 70 recognizes the type of ink to be ejected based on ink-type information stored in an ink cartridge memory ICm. This enables to perform the recognition surely. In addition, this also enables to perform adjustment automatically in case of replacement of an ink cartridge IC storing a different type of ink.

The above-mentioned switch-operation information (light-ink-specific switch-operation information and dark-ink-specific switch-operation information) is selected by a decoder 84. More specifically, in case in which a tone value transmitted from the latch circuit 82 is a tone value of non-ejection, the decoder 84 selects switch-operation information q0, and in case of a tone value of a small dot, the decoder 84 selects switch-operation information q1. In the same way, in case of a tone value of a medium dot, the decoder 84 selects switch-operation information q2, and in case of a tone value of a large dot, the decoder 84 selects switch-operation information q3. The switch-operation information selected among q0 through q3 is outputted to a head switch 86. As a result thereof, at least one period signal, among period signals SS1 through SS5 which the original drive signal COM contains, is selected and applied to a piezo element PZT.

More specifically, in case of switch-operation information q0, a second-period signal SS2 generated in a period T2 is applied to a piezo element PZT. That is, the second-period signal SS2 serves as a drive signal. Accordingly, a drive pulse PS2 (a micro-oscillation pulse) is applied to the piezo element PZT and micro-oscillation of the meniscus is caused. In case of switch-operation information q1, a fourth-period signal SS4 generated in a period T4 is applied to a piezo element PZT as a drive signal. Accordingly, a drive pulse PS4 (a small-dot pulse) is applied to the piezo element PZT and ink of an amount necessary to form a small dot is ejected from a nozzle Nz. In case of switch-operation information q2, a third-period signal SS3 generated in a period T3 is applied to a piezo element PZT as a drive signal. Accordingly, a drive pulse PS3 (a second medium-dot pulse) is applied to the piezo element PZT and ink of an amount necessary to form a medium dot is ejected from a nozzle Nz. Note that each of the above-mentioned operation is common between light ink and dark ink because these pieces of switch-operation information q0 through q2 are the same between light ink and dark ink.

In case of switch-operation information q3 of light ink, a first-period signal SS1 generated in a period T1 and a fifth-period signal SS5 generated in a period T5 are applied to a piezo element PZT as drive signals. Accordingly, a drive pulse PS1 (a first medium-dot pulse) and a drive pulse PS5 (a third medium-dot pulse) are applied to the piezo element PZT. Accordingly, ink of an amount necessary to form a large dot with light ink is ejected from a nozzle Nz. In the present embodiment, the amount of ink is 14 pl (14 ng) as mentioned above. On the other hand, in case of switch-operation information q3 of dark ink, the first-period signal SS1 generated in the period T1, the third-period signal SS3 generated in the period T3, and the fifth-period signal SS5 generated in the period T5 are applied to a piezo element PZT as drive signals. Accordingly, the drive pulse PS1 (the first medium-dot pulse), the drive pulse PS3 (the second medium-dot pulse), and the drive pulse PS5 (the third medium-dot pulse) are applied to the piezo element PZT. Accordingly, ink of an amount necessary to form a large dot with dark ink is ejected from a nozzle Nz. In the present embodiment, the amount of ink is 21 pl (21 ng) as mentioned above. It can be said that the printer 1 which performs these controls generates, for a specific tone value, a plurality of types of drive signals, each drive signal containing different types of drive pulses (waveform sections), and applies the generated drive signal to a piezo element PZT. An amount of ink for a large dot formed with light ink is set smaller than an amount of ink for a large dot formed with dark ink, and this enables to suppress a problem that a large dot formed with light ink is perceived excessively large and deterioration of graininess is caused. In short, this enables to form a dot having a specific tone value in desired size. As a result thereof, graininess of a print image can be improved and image quality can be improved. In addition, even when the print resolution is set lower than the conventionally-adopted print resolution, improvement of graininess enables to obtain the same image quality as obtained in the print resolution conventionally adopted. Therefore, print speed can be increased by lowering print resolution.

Also, in the printer 1, the control logic 83 (a switch-operation information storing section) is provided for each type of ink and each of the control logics 83 stores switch-operation information for each of the tone values. The decoder 84 selects switch-operation information for each of the tone values which is outputted by each of the control logics 83, based on the tone value. The head switch 86 operates based on the selected switch-operation information. In this configuration, controlling operation of the head switch 86 enables to generate easily a plurality of types of the drive signals from a common original drive signal COM. In addition, storing switch-operation information for each type of ink and for each tone value in the control logic 83 enables control in multiple tone levels, without the necessity of calculations by the CPU 72, etc. As a result thereof, the printing operation can be performed at higher speed. This also facilitates support for using different types of ink, since it is only necessary to rewrite the contents stored in the control logic 83.

In the first embodiment, the printer 1 which prints an image by using light ink and dark ink of the same color is described. The printer 1 has an advantage that graininess can be improved in an image to be printed with light ink and dark ink. However, this invention is not limited to the above-mentioned configuration. The section below describes other embodiments.

Regarding the Second Embodiment

Figures 15A, 15B:
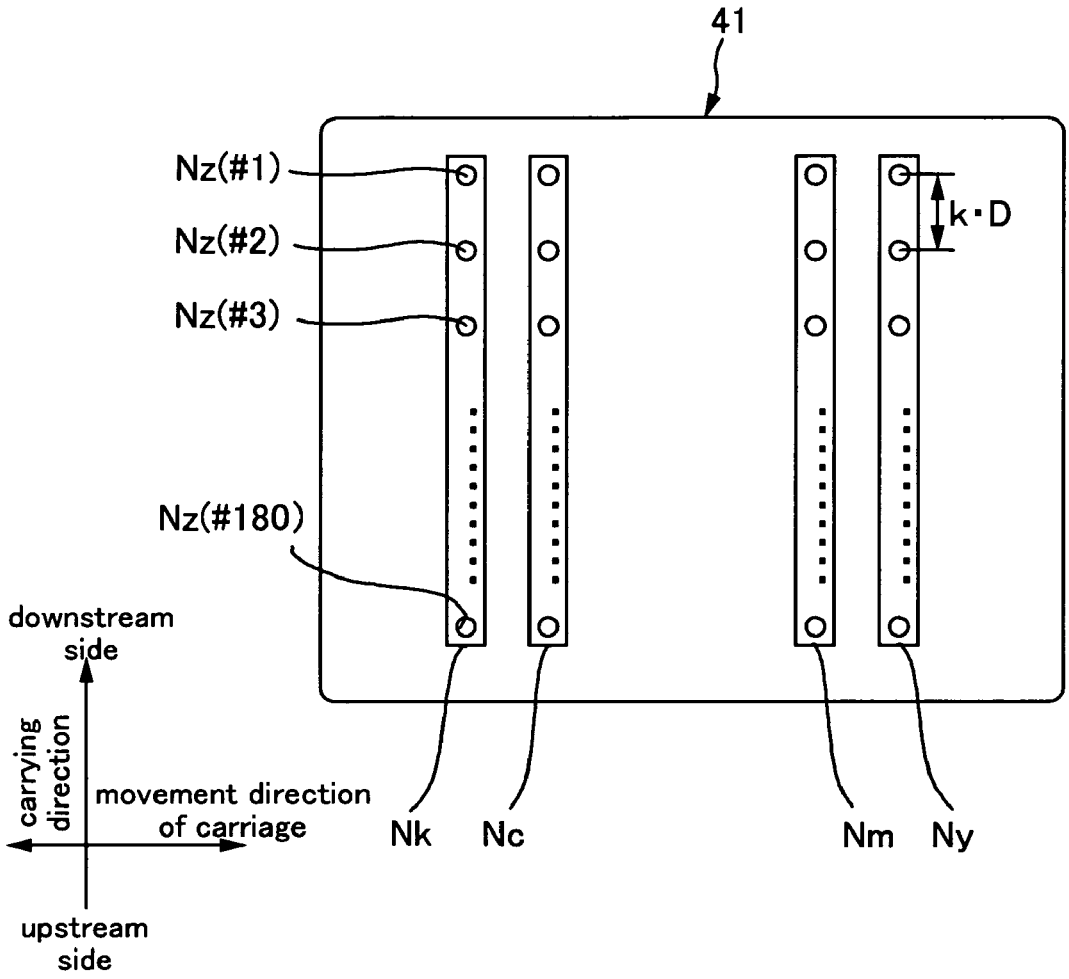
FIG. 15A is an explanatory diagram showing a head in the second embodiment.
FIG. 15B is a table showing control in the second embodiment.

This section describes the second embodiment. The second embodiment illustrates a printing apparatus which ejects a plurality of types of inks each having different brightness when the concentration of a color material contained in each ink is the same among the inks. Here, FIG. 15A is an explanatory diagram showing a head 41 in the second embodiment. FIG. 15B is a table showing control in the second embodiment.

The second embodiment illustrates a printing apparatus which ejects black ink, cyan ink, magenta ink, and yellow ink each having different brightness when the concentration of the color material contained in each ink is the same among the inks, as "inks each having different brightness when a concentration of a color material contained in the solvent of each ink is the same among the inks". More specifically, as shown in FIG. 15A, the head 41 is furnished with a black ink nozzle row Nk, a cyan ink nozzle row Nc, a magenta ink nozzle row Nm, and a yellow ink nozzle row Ny, and the head 41 ejects from each of the nozzle rows ink whose color corresponds to each of the nozzle rows. Here, brightness of yellow ink is higher than those of the other inks even when the concentration of the color material in the solvent of the yellow ink is the same as the other inks. Accordingly, it is considered that a dot formed with yellow ink is visually perceived larger than a dot formed with any of the other inks if an equal amount of ink is used for yellow ink and the other inks. Therefore, in case of a tone value of a large dot (a "specific tone value"), two medium-dot pulses are used for ejection of yellow ink and three medium-dot pulses are used for ejection of the other inks.

In short, in this embodiment, two types of drive signals having different drive pulses are generated for a tone value of a large dot such that an amount of yellow ink ejected (high brightness) is less than an amount of the other inks ejected (low brightness). This enables to optimize the size of a large dot formed with yellow ink and to improve graininess. Since ejection control of ink and the hardware configuration are the same as mentioned in the first embodiment, an explanation thereof is omitted.

Regarding the Third Embodiment

Figures 16A, 16B:
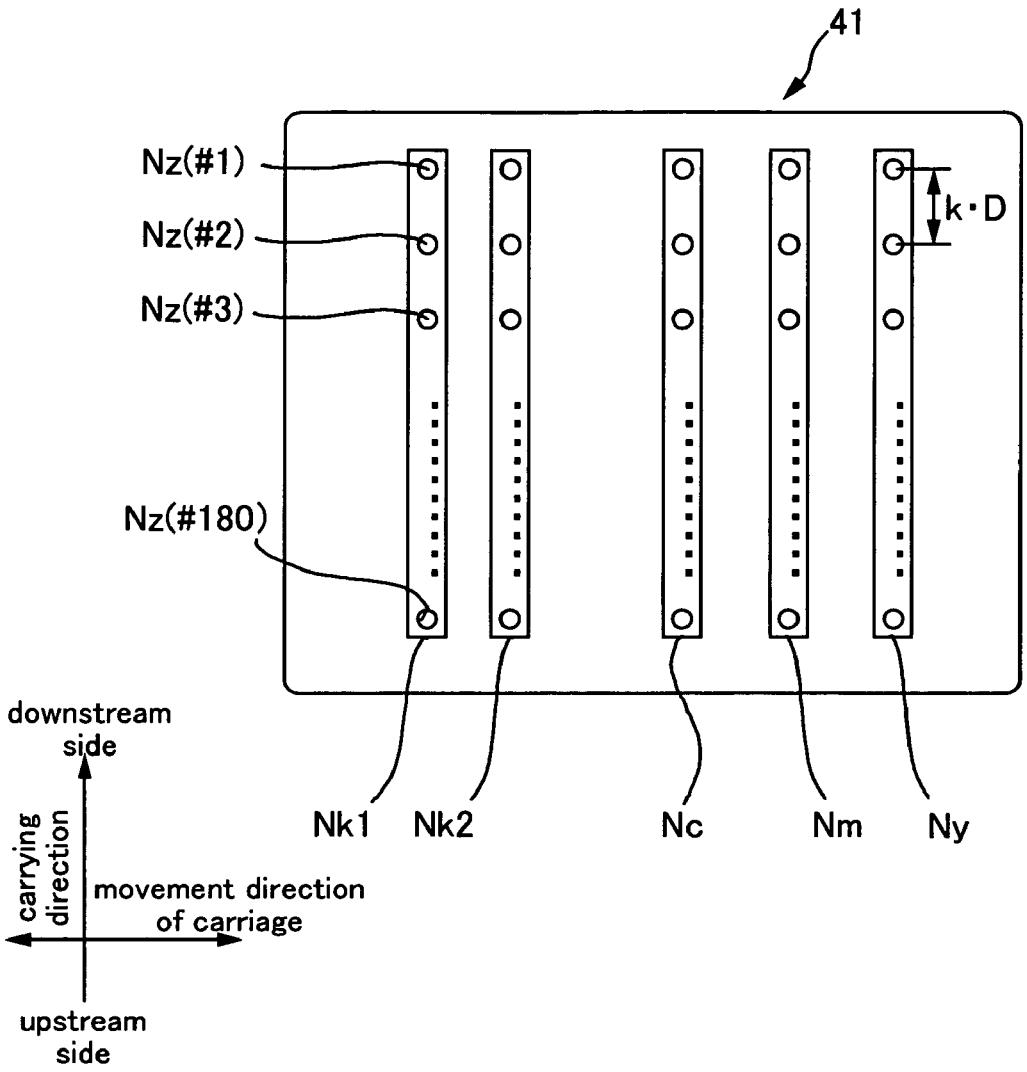
FIG. 16A is an explanatory diagram showing a head in the third embodiment.
FIG. 16B is a table showing control in the third embodiment.

This section describes the third embodiment. The third embodiment illustrates a printing apparatus which ejects dye ink and pigment ink. Here, FIG. 16A is an explanatory diagram showing a head 41 in the third embodiment. FIG. 16B is a table showing control in the third embodiment.

The head 41 in the third embodiment ejects two types of black ink: pigment black ink and dye black ink. The head 41 also ejects color ink: dye cyan ink, dye magenta ink, and dye yellow ink. Accordingly, as shown in FIG. 16A, the head 41 is furnished with a pigment black ink nozzle row Nk1, a dye black ink nozzle row Nk2, a dye cyan ink nozzle row Nc, a dye magenta ink nozzle row Nm, and a dye yellow ink nozzle row Ny. Here, a dot formed with dye black ink or dye color ink tends to be larger in size than a dot formed with pigment black ink even if an equal amount of ink is used for their respective formation. It is considered that this tendency is caused by difference in penetration of each ink into a medium such as a paper S. Therefore, in case of a tone value of a large dot (a "specific tone value"), two medium-dot pulses are used for ejection of dye black ink or dye color ink and three medium-dot pulses are used for ejection of pigment black ink.

In short, in this embodiment, two types of drive signals having different drive pulses are generated for a tone value of a large dot such that an amount of dye ink ejected is less than an amount of pigment ink ejected. This enables to optimize the size of a large dot formed with dye ink and to improve graininess. Since ejection control of ink and the hardware configuration are the same as mentioned in the first embodiment, an explanation thereof is omitted. The example of pigment ink in which pigment black ink is used can also apply to cases of pigment color ink.

Regarding Other Embodiments

Though each of the above-mentioned embodiments describes mainly the printer 1, it also includes disclosure of the printing apparatus, the printing method, the printing system 100 and the like. Though the printer 1 is described above as embodiments of the invention, the above-mentioned embodiments are provided for facilitating the understanding of the present invention, and are not to be interpreted as limiting the present invention. As a matter of course, the present invention can be altered and improved without departing from the gist thereof and the present invention includes equivalent thereof, especially embodiments mentioned below.

Regarding Specific Tone Value

In each of the above-mentioned embodiments, the number of tone levels is four and a plurality of types of drive signals are generated for the tone value of a large dot in the above-mentioned tone levels. However, this invention is not limited to the above-mentioned configuration. For example, a plurality of types of drive signals can be generated for the tone value of a dot which is larger than a predetermined size. The embodiment shown in FIGS. 17A and 17B is one in which formation of a dot can be controlled under six tone levels: non-formation of a dot, formation of a first small dot, formation of a second small dot, formation of a first medium dot, formation of a second medium dot, and formation of a large dot, in ascending order of the amount of ink ejected. In this example, in case of a fifth tone level (the second medium dot) and a sixth tone level (the large dot), different drive signals are used depending on whether a dot is formed with light ink or dark ink. In short, the fifth tone level and the sixth tone level correspond to specific tone values. This configuration can achieve the same effects as achieved in each of the above-mentioned embodiments. In other words, this enables to effectively suppress deterioration of graininess which is conspicuous in formation of a dot being larger than a dot corresponding to the fifth tone level, that is, which tends to be more conspicuous as a dot becomes larger. Note that the number of tone levels is not limited to four tone levels or six tone levels. For example, three tone levels or seven or more tone levels are also acceptable.

Regarding Drive Signal

In each of the above-mentioned embodiments, different drive signals are generated from a common original drive signal COM by using different combinations of drive pulses (waveform sections). On this point, a plurality of types of original drive signals COM can be generated by providing a plurality of original drive signal generating circuits 50.

Regarding Printer 1

The above-mentioned embodiments are explained with illustrating a printer 1 which has a single function and performs printing only. However, a printing apparatus in the invention is not limited to such a printer 1. For example, the printer 1 can be replaced with an apparatus which has functions of the printer 1 and functions of a scanner, such as a printer/scanner multifunction machine. Otherwise, a plotter or a facsimile can also be used as mentioned above. In addition, the same technology as mentioned in the present embodiment can apply to a variety of printing apparatuses utilizing inkjet technology: color filter manufacturing equipment, dyeing equipment, micromachining equipment, semiconductor manufacturing equipment, surface treatment equipment, three-dimensional molding machine, a vaporizer, organic EL manufacturing equipment (especially, polymer EL manufacturing equipment), display manufacturing equipment, film formation equipment, and DNA chip manufacturing equipment. In addition, methods used therein and manufacturing methods thereof are also included in applications to which the technology as mentioned in the present embodiment can apply.

Regarding Elements Contained in Head 41

In each of the above-mentioned embodiments, a piezo element PZT is exemplified as an element contained in a head 41, that is, an element performing operation for ejecting ink. However, the invention is not limited to the piezo element PZT. For example, an electrostatic actuator, a magnetostrictive element, or a heating element can also be an element contained in the head 41.

What is claimed is:

1. A printing apparatus, comprising:

a head that has an element performing operation for ejecting ink and that ejects a plurality of types of inks, an amount of each ink ejected by the head being different depending on a designated tone value; and a drive signal generating section that generates a drive signal having a waveform section for operating the element and that generates a plurality of types of the drive signals for a specific tone value, the waveform section of each of the drive signals for the specific tone value being different depending on the types of inks, wherein:

the drive signal generating section comprises:

an original drive signal generating section that generates an original drive signal having a plurality of the waveform sections;

a switch that is arranged between the original drive signal generating section and the element and that is for generating from the original drive signal a drive signal to be applied to the element;

a switch controller that controls operation of the switch based on the designated tone value and the type of ink; and a switch-operation information storing section storing, for each of the types of inks and each of the tone values, switch-operation information that is for determining the operation of the switch, and the switch controller selects a piece of switch-operation information corresponding to the designated tone value and the type of ink and controls the operation of the switch using the selected switch-operation information.

2. The printing apparatus according to claim 1, wherein:

in the drive signal generating section, a tone value corresponding to a dot that is larger than a predetermined size serves as the specific tone value.

3. The printing apparatus according to claim 1, wherein:

in the drive signal generating section, a tone value corresponding to a largest dot serves as the specific tone value.

4. The printing apparatus according to claim 1, wherein:

the head ejects, as a plurality of the types of inks, light ink and dark ink of a same color; and the drive signal generating section generates for the specific tone value a plurality of types of the drive signals whose respective waveform sections differ such that an ejected amount of the light ink is less than an ejected amount of the dark ink.

5. The printing apparatus according to claim 1, wherein:

the head ejects, as a plurality of the types of inks, inks each having different brightness when a concentration of a color material contained in each ink is the same among the inks; and the drive signal generating section generates for the specific tone value a plurality of types of the drive signals whose respective waveform sections differ such that an ejected amount of ink with high brightness is less than an ejected amount of ink with low brightness.

6. The printing apparatus according to claim 5, wherein:

the head ejects, as a plurality of the types of inks, black ink, cyan ink, magenta ink, and yellow ink each having different brightness when a concentration of a color material contained in each ink is the same among the inks; and the drive signal generating section generates for the specific tone value a plurality of types of the drive signals whose respective waveform sections differ such that an ejected amount of the yellow ink with high brightness is less than an ejected amount of an other ink with low brightness.

7. The printing apparatus according to claim 1, wherein:

the head ejects, as a plurality of the types of inks, dye ink and pigment ink; and the drive signal generating section generates for the specific tone value a plurality of types of the drive signals whose respective waveform sections differ such that an ejected amount of the dye ink is less than an ejected amount of the pigment ink.

8. The printing apparatus according to claim 1, comprising:

an ink storage container that stores a plurality of the types of inks and that includes a container-side storage section that stores ink-type information indicating the types of inks stored; wherein:

the drive signal generating section recognizes a type of ink to be ejected based on the ink-type information stored in the container-side storage section.

9. A printing apparatus, comprising:

(A) an ink storage container that stores a plurality of types of inks and that includes a container-side storage section that stores ink-type information indicating the types of inks stored;

(B) a head that has an element performing operation for ejecting ink and that ejects a plurality of the types of inks, an amount of each ink ejected by the head being different depending on a designated tone value; and (C) a drive signal generating section that generates a drive signal having a waveform section for operating the element, and that has:

(C1) an original drive signal generating section that generates an original drive signal having a plurality of the waveform sections;

(C2) a switch that is arranged between the original drive signal generating section and the element and that is for generating from the original drive signal a drive signal to be applied to the element;

(C3) a switch-operation information storing section storing, for each of the types of inks and each of the tone values, switch-operation information that is for determining operation of the switch; and (C4) a switch controller that selects a piece of switch-operation information corresponding to the designated tone value and the type of ink and that controls the operation of the switch using the selected switch-operation information;

(C5) wherein the drive signal generating section recognizes a type of ink to be ejected based on the ink-type information stored in the container-side storage section, treats a tone value corresponding to a dot that is larger than a predetermined size or a tone value corresponding to a largest dot as a specific tone value, and generates a plurality of types of the drive signals for the specific tone value, the waveform section of each of the drive signals for the specific tone value being different depending on the types of inks; wherein:

(D) the head ejects, as a plurality of the types of inks:

(D1) light ink and dark ink of a same color;

(D2) black ink, cyan ink, magenta ink, and yellow ink each having different brightness when a concentration of a color material contained in each ink is the same among the types of inks; or (D3) dye ink and pigment ink; and (E) the drive signal generating section generates for the specific tone value:

(E1) a plurality of types of the drive signals whose respective waveform sections differ such that an ejected amount of the light ink is less than an ejected amount of the dark ink;

(E2) a plurality of types of the drive signals whose respective waveform sections differ such that an ejected amount of the yellow ink with high brightness is less than an ejected amount of an other ink with low brightness; or (E3) a plurality of types of the drive signals whose respective waveform sections differ such that an ejected amount of the dye ink is less than an ejected amount of the pigment ink.

10. A printing method, comprising:

generating, for a specific tone value among a plurality of tone values, a plurality of types of drive signals each having a waveform section that is for operating an element performing operation for ejecting ink and that differs among types of inks; and ejecting ink at the specific tone value from a head by applying to the element a plurality of the types of drive signals, generating, by a switch, from the original drive signal a drive signal to be applied to the element;

controlling operation of the switch based on designated tone value and the type of ink;

storing, for each of the types of inks and each of the tone values, switch-operation information that is for determining the operation of the switch;

selecting a piece of switch-operation information corresponding to the designated tone value and the type of ink; and controlling the operation of the switch using the selected switch-operation information.

* * * * *